US005189246A

United States Patent [19]

Marsh et al.

[11] Patent Number: 5,189,246

[45] Date of Patent: Feb. 23, 1993

[54] TIMING APPARATUS

[75] Inventors: Michael J. C. Marsh, Johannesburg; Raymond C. Atkins, Pretoria; Trevor M. Hodson, Randburg, all of South Africa

[73] Assignee: CSIR, Transvaal, South Africa

[21] Appl. No.: 587,914

[22] Filed: Sep. 25, 1990

[30] Foreign Application Priority Data

Sep. 28, 1989 [ZA] South Africa ..... 89/7389

[51] Int. Cl.[5] ..... F23Q 21/00

[52] U.S. Cl. ..... 102/217; 102/202.1

[58] Field of Search ..... 102/217, 202.1, 202.3, 102/207, 218, 220

[56] References Cited

U.S. PATENT DOCUMENTS

| | | | |
|---|---|---|---|
| Re. 32,888 | 3/1989 | Kirby et al. | 102/217 |
| 2,546,686 | 3/1951 | Bickel et al. | 102/217 |
| 3,312,869 | 5/1964 | Werner | 102/268 |
| 4,646,640 | 3/1987 | Florin et al. | 102/217 |
| 4,976,199 | 12/1990 | Beukes et al. | 102/217 |

FOREIGN PATENT DOCUMENTS

| | | | |
|---|---|---|---|
| 2352273 | 12/1977 | France | 102/217 |

*Primary Examiner*—Stephen M. Johnson

*Attorney, Agent, or Firm*—Lowe, Price, LeBlanc & Becker

[57] ABSTRACT

The invention relates to a blasting apparatus for activating a plurality of electrical detonators after predetermined time delays. The blasting apparatus includes a plurality of remote electrical delay devices. Each device is linked to a detonator, and is arranged to be serially programmed with a timing signal, which originates from the central control unit and which determines the time delay. A bidirectional signal harness, having ends which terminate at I/O ports in the control unit, serially links the delay devices to the control unit. In the event of a fault of discontinuity occurring in the harness prior to programming of the delay devices, the discontinuity is detected and the direction of programming along the bidirectional harness is reversed so that those delay devices which, due to the break, cannot be programmed in the initial direction, are programmed with timing signals travelling along the signal line in the opposite direction. The invention extends to a method of activating a plurality of electrical detonators, as well as to the individual delay devices forming part of the blasting apparatus.

21 Claims, 18 Drawing Sheets

FIG. 3C

LEVELS OF SAFETY

| ACTION | MAIN SWITCH | HARNESS LINES | LOGIC POWER | DET POWER | ENERGY STORE | ABORT | SAFETY LEVEL |
|---|---|---|---|---|---|---|---|
| 1. CONNECTION OF HARNESS TO DELAY DEVICES AND CONTROLLER | OFF | SHORTED TO EARTH | OFF | OFF | UNABLE TO TRIGGER THE LOAD | YES | 5 |
| 2. SWITCH ON | ON | - DITTO - | OFF | OFF | - DITTO - | YES | 4 |
| 3. SELECT TIMING PATTERN | ON | - DITTO - | OFF | OFF | - DITTO - | YES | 4 |
| 4. TWO HOUR WAIT | ON | - DITTO - | OFF | OFF | - DITTO - | YES | 4 |
| 5. MOVE MOTOR SLUG TO ENABLED POSITION | ON | CONNECTED TO MICRO-PROCESSOR | OFF | OFF | - DITTO - | YES | 3 |
| 6. PROGRAMMING THE DELAY DEVICES | ON | - DITTO - | ON | OFF | - DITTO - | YES | 2 |
| 7. REVERSE PROG IF REQUIRED | ON | - DITTO - | ON | OFF | - DITTO - | YES | 2 |
| 8. CHARGE THE ENERGY STORE | ON | - DITTO - | ON | ON | ABLE TO TRIGGER LOAD | NO | 1 |
| 9. TRIGGER THE DELAY DEVICES | ON | - DITTO - | OFF | OFF | - DITTO - | NO | BLAST |
| 10. RETURN MOTOR SLUG TO DISABLED POSITION | ON | SHORTED TO EARTH | OFF | OFF | N/A | NO | 5 |

TIMING APPARATUS

BACKGROUND OF THE INVENTION

This invention relates to a timing apparatus, and in particular to a timing apparatus for activating a plurality of electrical loads at predetermined time intervals in blasting operations.

During mining and quarrying operations, it is necessary to detonate a series of explosive charges in an accurately timed sequence to achieve the correct blast pattern. In the past, the most common way of achieving this has been to use a train of pyrotechnic delay fuses and ignitor cord to link up detonators. In recent years however, systems for generating a controlled sequence of electrical timing signals have been introduced (see, for instance, U.S. Pat. Nos. 2,546,686 and 3,212,869, and South African Patent No. 79/0355).

In South African Patent No. 79/0355, a system is described in which a central control unit programmes a plurality of remote delay devices with corresponding reference timing signals via an electrical cable line and subsequently activates the detonators to which the delay devices are attached.

Rockfalls and explosions elsewhere in the mine can damage both the remote delay devices and the electrical harness line interlinking these devices and the control unit. If this occurs before or during programming, then it becomes necessary to abort the blasting operation, as some of the delay devices have not been provided with their reference timing signals, and cannot be subsequently triggered.

Electrical failure or malfunctions in the central control unit or in the remote delay devices may also lead to serious accidents.

As a mine is generally evacuated during blasting, the down-time wasted as a result of such malfunctions occuring is extremely costly.

SUMMARY OF THE INVENTION

According to the first aspect of the invention, there is provided apparatus for activating a plurality of electrical loads after predetermined time delays.

The apparatus includes a central control unit for generating timing signals and a plurality of remote electrical delay devices, each device being associated with a corresponding electrical load. The remote electrical delay devices are arranged to be serially programmed by a timing signal originating from the central control unit. The timing signal determines the time delay. At least one bidirectional timing signal line allows the timing signals to be transmitted in series from the central control unit to each remote electrical delay device in either of two preselected directions.

In a preferred form of the invention, the apparatus further comprises sensing means for sensing a fault in the timing signal line, and direction selection means for selecting the direction of transmission of the timing signals from either the first or the second ports. The direction selection means select a direction of transmission opposite to the initial direction of transmission of the timing signals from the control unit in the event of a fault sensed in the timing signal path, for programming those delay devices which cannot be programmed in the initial direction.

Conveniently, the apparatus further includes monitoring means for monitoring the number of electrical delay devices which have been correctly programmed, and deactivation means for deactivating the delay devices and aborting the blasting procedure in the event of a predetermined number of the delay devices not having been programmed correctly or at all.

Preferably, the monitoring means includes fault location means for locating the position of a fault in relation to the delay devices, and counting means for counting the number of delay devices on opposite sides of the fault, for establishing the correct timing signal pattern to ensure that each delay device is programmed with its corresponding timing signal.

The control unit preferably has first and second signal I/O ports to which opposite ends of the timing signal line are connectable, the second signal I/O port in use receiving a signal transmitted from the first signal I/O port, and vice versa, in the event of no fault existing in the timing signal line.

In a preferred form of the invention, the control unit includes both timing and triggering signal generating means, and each electrical delay device is configured to activate its associated electrical load a predetermined time delay after receipt of a triggering signal, and may further include power signal generating means for generating power signals for powering up each delay device.

Conveniently, the timing, triggering and power signals are transmissible along separate respective bidirectional timing, triggering and power signal lines which together constitute a harness. The ends of the harness are connectable to ports a the control unit, which include the first and second respective signal output ports.

The harness preferably includes a ground line. Each delay device is connectable to the control unit in parallel between the triggering and power signal lines and the ground line, so as to receive power and triggering signals simultaneously from the control unit.

The sensing means may comprise microprocessor-controlled signal generating means for generating a test signal and for transmitting the test signal from one of the ports of the control unit to another along one of the signal lines, and test signal receipt means for detecting the presence or otherwise of the test signal at the opposite port from which it was transmitted.

The direction selection means is preferably responsive to the sensing means, and forms part of a microprocessor-based routine at the control unit.

The monitoring means may be in the form of a counter for counting the number of timing signals received at one of the ports of the control unit along one of the signal lines. A memory module for stores the number of delay devices utilized for a particular blasting operation. A comparator compares the number of signals received with the number of delay devices stored in the memory module.

Safety control means are preferably provided for ensuring that the delay devices are not programmed or triggered by spurious signals. The safety control means include switching means for disconnecting the signal lines from the control unit and for shorting them to the ground line.

The switching means are preferably operable by a motor-powered slug from a safe position, in which the signal lines are isolated from the control unit and shorted to earth, to an enabled position in which the signal lines are connected to the ports of the controller.

Microcomputer monitoring means may be provided to monitor a microcomputer which controls the operation of the control unit, and power supply means for powering the power and trigger signal lines. The microcomputer monitoring means only activates the power supply means in the event of the operating normally.

In one form of the invention, the central control unit includes a precise timing pulse generator, measuring means for measuring pulse duration and computation means for computing a correction factor. Each delay device includes an imprecise timing pulse generator, and each delay device is responsive to a signal from the control unit to transmit at least one imprecise timing pulse to the control unit for measure of the duration thereof using the measuring means. The computation means compute a correction factor on the basis of the ratio between the duration of the imprecise timing pulse and a precise timing pulse from the precise timing pulse generator. This correction factor is applied to a timing signal for receipt by a delay device.

The imprecise and precise pulse generators may be in the form of respective local and precision oscillators, and the timing signal may be in the form of a digital word.

According to a second aspect of the invention, there is provided a method of activating a plurality of electrical loads after predetermined time delays comprising the steps of:

a) providing a central control unit for generating timing signals which determine the time delays;

b) providing a plurality of remote electrical delay devices, each delay device being associated with a corresponding electrical load;

c) providing a bidirectional timing signal line for connecting the delay devices in series with the central control unit;

d) transmitting the timing signals in series from the central control unit along the bidirectional timing signal line to each remote electrical delay device for programming thereof;

e) selecting the direction of transmission of the timing signals along the bidirectional timing signal line.

Preferably, the method includes the steps of detecting a fault in the bidirectional signal line and selecting the direction of transmission of the timing signals along the bidirectional timing signal line in accordance with the location of the fault.

Conveniently, the method includes the further steps of monitoring the number of electrical delay devices which have been programmed with timing signals and deactivating the control unit and the delay devices and aborting the blasting procedure in the event of at least one of the delay devices not having been programmed correctly or at all.

The further steps of locating the position of a fault in relation to the delay devices, and counting the number of delay devices on opposite sides of the fault between the fault and the control unit for establishing the correct timing signal pattern to ensure that each delay device is programmed with its correct corresponding timing signal may preferably be followed.

In a preferred form of the invention, there are provided the further steps of generating a triggering signal at the central control unit subsequent to programming of the delay devices, and transmitting the triggering signal simultaneously to all of the delay devices for activating the electrical loads after the predetermined time delays in respect of each delay device have lapsed.

Power signals are preferably also transmitted from the central control unit for powering up each delay device.

Preferably, the timing, triggering and power signals are transmitted along separate respective bidirectional timing, triggering and power signal lines, the lines together constituting a harness which is connectable to separate I/O ports at the control unit.

The method preferably includes the step of providing a ground line in the harness, connecting each delay device in parallel between the triggering and power signal lines and the ground line and in series with the timing signal line, and receiving at each delay device power and triggering signals simultaneously and timing signals serially from the control unit.

In a preferred form of the invention, there are included the steps of transmitting timing signals in series from first or second signal I/O ports at the control unit, and monitoring the progress of programming of the delay devices by receiving the timing signals at a signal input port, non-receipt of the timing signals at the signal input port being indicative of a fault in the timing signal line.

Conveniently, the method includes the preliminary steps of isolating the signal lines from the controller and shorting them to earth, selecting at the central control unit the timing pattern for blasting in respect of each delay device, connecting the signal lines to the control unit after the elapsing of a stand-off time, and programming the delay devices with timing signals from the central control unit.

The subsequent steps of charging the energy storage means in the delay devices with a charge signal from the control unit along one of the signal lines, triggering the delay devices with the trigger signal from the control unit via the trigger signal line, and directly thereafter disconnecting the signal lines from the controller and shorting them to the ground line.

The further step of monitoring the functioning of a microcomputer which controls the control unit, and only allowing triggering and powering signals to be transmitted along the signal lines in the event of the microcomputer functioning normally is preferably included in the invention.

In one form of the invention, the method includes the further steps of transmitting at least one imprecise timing pulse from a delay device to the control unit, generating at least one precise timing pulse at the control unit, measuring the duration of the imprecise timing pulse, computing a correction factor on the basis of the ratio between the duration of the imprecise and precise timing pulses, and applying this correction factor to a timing signal for receipt by the delay device.

According to a third aspect of the invention, there is provided an electrical delay device for activating an electrical load associated therewith after a predetermined time delay, the electrical delay device being serially connectable to a bidirectional timing signal path, and being arranged to receive a timing signal, which is a function of the predetermined time delay, from a central control unit, the electrical delay device comprising:

a) first timing signal steering means for steering a timing signal arriving at the delay device in a first direction along the bidirectional timing signal path;

b) second timing signal steering means for steering a timing signal arriving at the delay device in a second direction along the bidirectional timing signal path;

the first and second timing signal steering means being operable to function in a signal storage mode for allowing storage of a timing signal in the delay device, and a signal bypass mode, in which a timing signal is permitted to bypass the delay device.

Preferably, the first and second timing signal steering means are further operable to function in a timing signal blockage mode, for preventing the passage of timing signals through or into the delay device.

Direction sensing means may be provided for selectively enabling either the first or the second timing signal steering means for allowing the receipt of timing signals travelling in either the first direction or the second direction.

Timing signal storage control means may be included to allow storage of a timing signal when the first or second timing signal steering means are in the signal storage mode, and to prevent storage of a subsequent timing signal arriving at the delay device.

The electrical delay device is preferably arranged to receive a triggering signal from the central control unit for activating the electrical load associated with the delay device a predetermined time delay after receipt thereof.

Fault detection means are conveniently provided for detecting a fault in the bidirectional timing signal path to which the delay device is in use serially connected, the fault detection means being operative to prevent the receipt of a timing signal in a direction corresponding to the direction in which the fault was detected.

The direction selection means may be responsive to a direction selection signal arriving in a first or second direction along the bidirectional timing signal path.

Conveniently, the electrical delay device has first and second terminals which are serially connectable to the bidirectional timing signal path.

Each of the first and second timing signal steering means may include at least two controlled switches, the controlled switches being arranged to operate in combination in at least three states respectively corresponding to the signal storage, bypass and blockage modes.

The controlled switches may be in the form of a pair of unidirectional buffers linked in series for accepting signals travelling in either the first or the second directions.

The first and second signal steering means preferably together comprise a bidirectional buffer arrangement constituted by at least two pairs of oppositely directed unidirectional buffers linked together in anti-parallel.

Each of the two controlled switches may optionally include a first controlled switch which is operative to maintain a first voltage level at one of the terminals of the delay device, for allowing the receipt of a timing signal at that terminal, and a second controlled switch which is operative at a second voltage level to allow propagation of a timing signal from one terminal to another, the output of the second controlled switch being at least partly determined by the first voltage level.

The first controlled switch may be in the form of a transistor arranged in series with a pull-up resistor to raise the voltage level of one of the terminals, and the second controlled switch is in the form of a transistor arranged to ground the other terminal.

The direction selection means may be operative to set the first and second timing signal steering means so as to receive timing signals travelling only in the direction of travel established by a direction selection signal.

The timing storage control means may optionally be operative to allow storage of a timing signal in the delay device, and to prevent storage of subsequent timing signals in the storage means after the first or second timing signal steering means have operated in the signal storage mode.

Conveniently, each electrical delay device includes charge storage means for receiving a charge storage signal from the central control unit, the charge storage means being arranged to power the delay device on receipt of the triggering signal and to activate the electric load a predetermined time delay after receipt of the triggering signal.

The timing signals may be in the form of a real time signal, a digital word or any other signal which conveys timing information from the control unit to each delay device.

The fault in the timing or other signal lines may arise as a result of a discontinuity in the signal lines due to a break in the harness, a faulty connection to one or more of the delay devices, a fault in the delay devices themselves, an undesirable short to ground or to a positive or negative voltage in the signal lines of the harness or in the delay devices, or any other spurious signal conditions arising in either the harness lines or in one or more of the delay devices.

BRIEF DESCRIPTION OF THE DRAWINGS

FIG. 3C shows a safety level diagram illustrating the various safety levels of the timing apparatus of FIG. 2;

DESCRIPTION OF EMBODIMENTS

Figure 1:
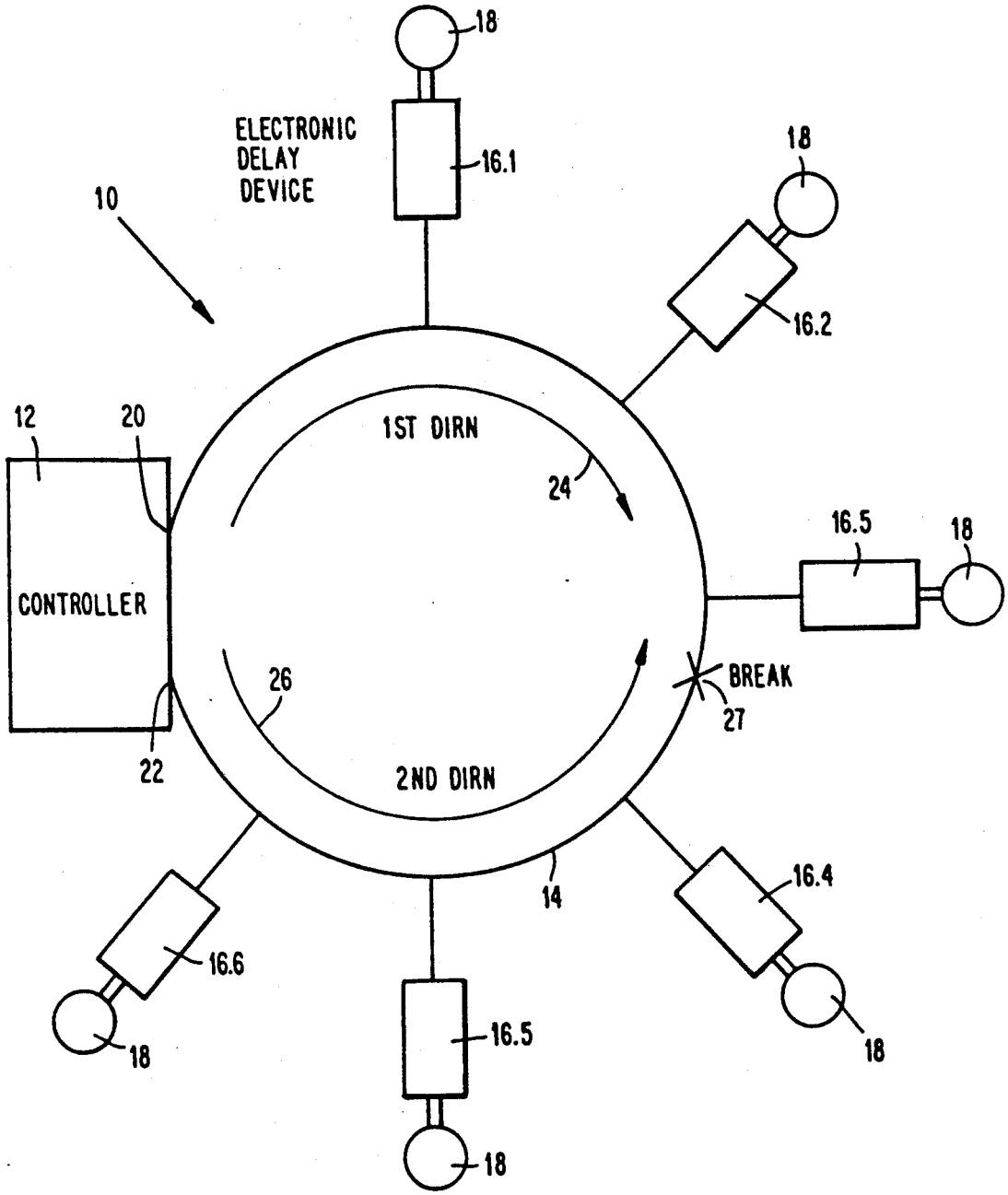
FIG. 1 shows a highly schematic representation of the main components of a timing apparatus of the invention.

Referring to FIG. 1, a timing apparatus 10 is in the first embodiment about to be described intended for use in mining or quarrying operations for the detonation of explosives at predetermined times after a triggering signal. In broad terms, the timing apparatus 10 comprises a control unit or controller 12 electrically linked in series by means of a harness 14 to a number of remote electronic delay devices 16.1, 16.2, 16.3, 16.4, 16.5 and 16.6, each of which are in turn connected to a corresponding electrical load or detonator 18 for setting off an explosive charge. The harness 14 is in the form of a loop having its ends connectable to first and second, or A and B ports 20 and 22 at the controller 12. As will be described in more detail further on in the specification, the harness 14 includes a timing signal path in the form of a programming line, which connects the delay devices together in series for serial programming thereof with timing signals from the controller. The harness also includes a number of power lines and a ground line which link the delay devices together in parallel, providing for the simultaneous powering up of the delay devices, and for allowing the transmission of a triggering signal for actuating the delay devices after predetermined time delays, which are determined by the timing signals which have been programmed into each delay device.

This arrangement allows timing signals from the controller 12 to be programmed serially into each delay device 16, each timing signal having a specific duration or time interval. As will be described in more detail further on in the specification, a subsequent firing signal simultaneously initiates a count down of the time intervals stored in each of the delay devices, thereby activating the detonator associated with each delay device after the timing interval has lapsed. Owing to the loop-like formation of the harness 14 and to the input/output configuration of the delay devices, timing signals from the controller 12 can be programmed into the delay devices 16.1 to 16.6 either in a clockwise or in an anti-clockwise direction, indicated by respective arrows 24 and 26.

Should a break 27 in the harness 14 occur, due to a rockfall for instance, it becomes necessary to implement bidirectional programming by sourcing timing signals from both the first and second ports 20 and 22 of the controller 12 in order to program all the delay devices. Delay devices 16.1, 16.2 and 16.3 are programmed with timing signals emanating from the first port 20. The controller re-routes the further timing signals so that they emanate from the second port 22, allowing the delay devices 16.4, 16.5 and 16.6 to be programmed in the anti-clockwise direction.

In order to understand how this, and other functions of the timing apparatus operate, the separate components, and the manner in which they interact, will now be discussed in more detail.

Figure 2:
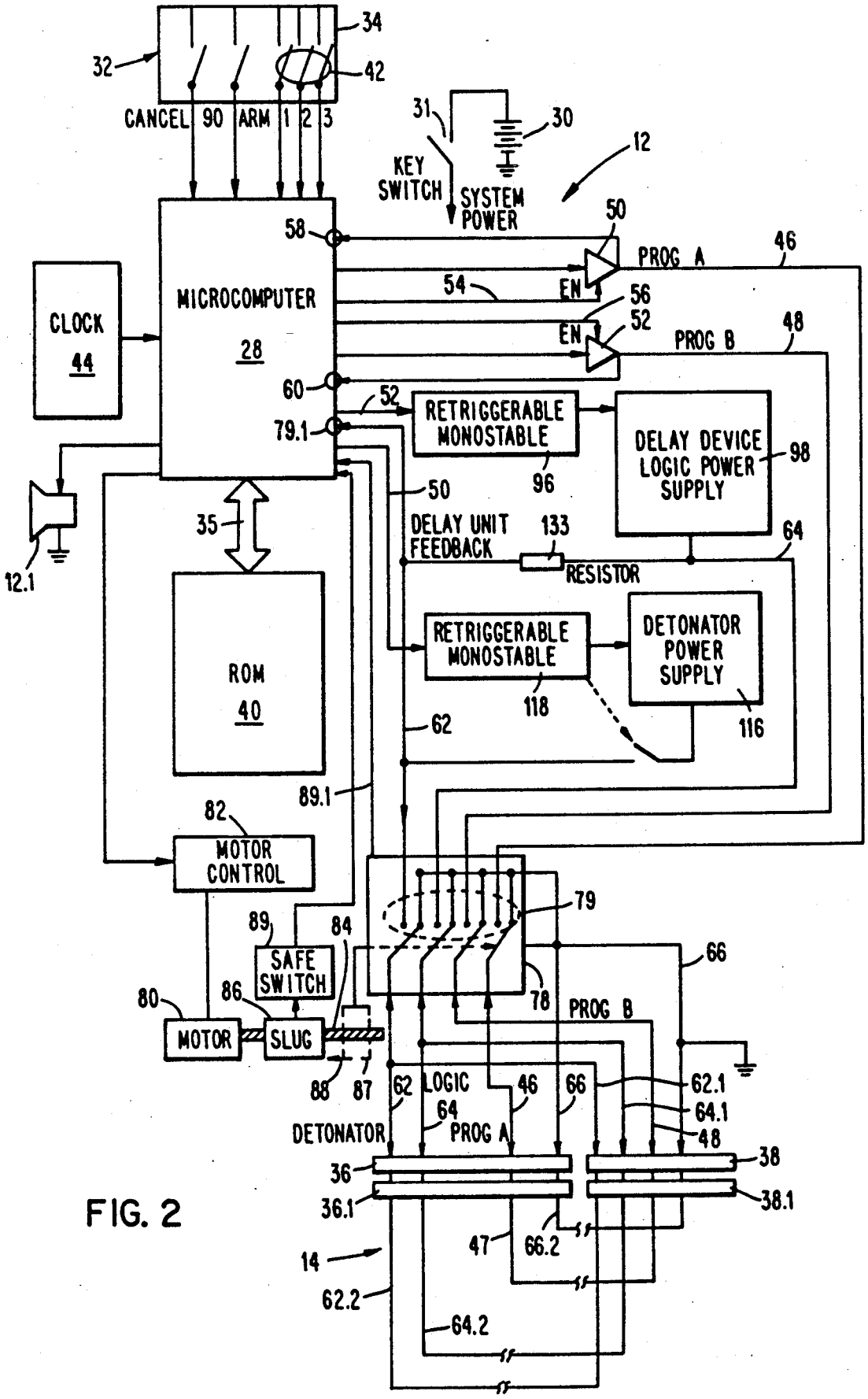
FIG. 2 shows a detailed functional block diagram of a central control unit or controller of a first embodiment of the invention.

The controller 12 of FIG. 2 has a central microcomputer 28, which is powered by a battery 30 operated by a key switch 31. The functions of the microcomputer 28 are manually controlled by means of a series of switches 32 mounted on a control panel 34.

The microcomputer 28 is connected via a bus interface 35 to a ROM look-up table 40 in which is stored a variety of reference timing signal patterns, one of which may be selected by means of selector switches 42. Programming may optionally be implemented via a keypad for more specific or unusual applications in which a non-standard blast pattern is applied. A stand-off clock 44 is linked to the microcomputer 28, and provides a stand-off time to allow the operators to vacate the area before the blasting sequence commences.

A number of output lines lead from the microcomputer 28. These include a PROG A line 46 and a PROG B line 48, which are connected to the microcomputer 28 via first and second tri-state buffers 50 and 52 respectively. The buffers are actuable by means of signals from respective first and second enable lines 54 and 56. The PROG A and PROG B lines terminating in separate respective I/O ports 58 and 60 at the microcomputer 28.

Four separate lines lead from the controller 12 to a harness connector 36 at the first port 20, namely DETONATOR and LOGIC power lines 62 and 64, the PROG A line 46 and a GROUND line 66. Likewise, four separate lines lead to the harness connector 38 at the second port 22, two (the DETONATOR line 62.1 and the LOGIC line 64.1) of which are offshoots from those lines leading to the harness connector 36, the common GROUND line 66, and the PROG B line 48. It follows that the harness 14 has four corresponding lines; a DETONATOR line 62.2, a LOGIC line 64.2, a PROG line 47 and a GROUND line 66.2

Opposite ends of the separate lines of the harness are fed to male connectors 36.1 and 38.1 which are operatively plugged into the corresponding harness connectors 36 and 38. This results in the LOGIC line, formed from the individual lines 64, 64.1 and 64.2, as well as the DETONATOR line, comprising the lines 62, 62.1 and 62.2, forming continuous loops. The PROG A line 46 and the PROG B line 48 form an open loop with the PROG line 47.

The DETONATOR, LOGIC, PROG A and PROG B lines 62, 64, 46 and 48 are linked to the controller via a shorting switch unit 78 which comprises a series of shorting switches 79. The DETONATOR line 62 is in turn lined to the microcomputer 28 via an I/O port 79.1

A motor 80 having a motor control unit 82 controlled by the microcomputer 28 is provided with a threaded shaft 84 which carries a slug 86, which is mechanically linked to the shorting switches 79. Rotation of the shaft 84 causes the slug 86 to move from a disabled position indicated in broken outline 87, in which the harness lines are earthed, in the direction of arrow 88 to an enabled position in which the slug 15 is indicated in solid outline, and the harness lines are connected to the controller 12. Rotation of the shaft 84 in the opposite direction will naturally cause the slug 86 to move the switches 79 back to the disabled position.

A "safe" switch 89 is actuated by the slug 86 when in the disabled position, transmitting a signal to the microcomputer 28 once so actuated. If the microcomputer 28 does not receive such a signal after being initially powered up, it will actuate the motor 80 via the motor control unit 82 to move the slug 86 to the disabled position if the slug 86 is not already in such a position. If, due to a faulty motor 80 or motor control unit 82, the slug 86 does not move to the disabled position, the controller 12 "times out" and the blast is aborted. A signal is transmitted via a signal line 89.1 from the switch unit 78 to indicate to the microcomputer 28 when the slug has reached the enabled position.

Figure 3A:
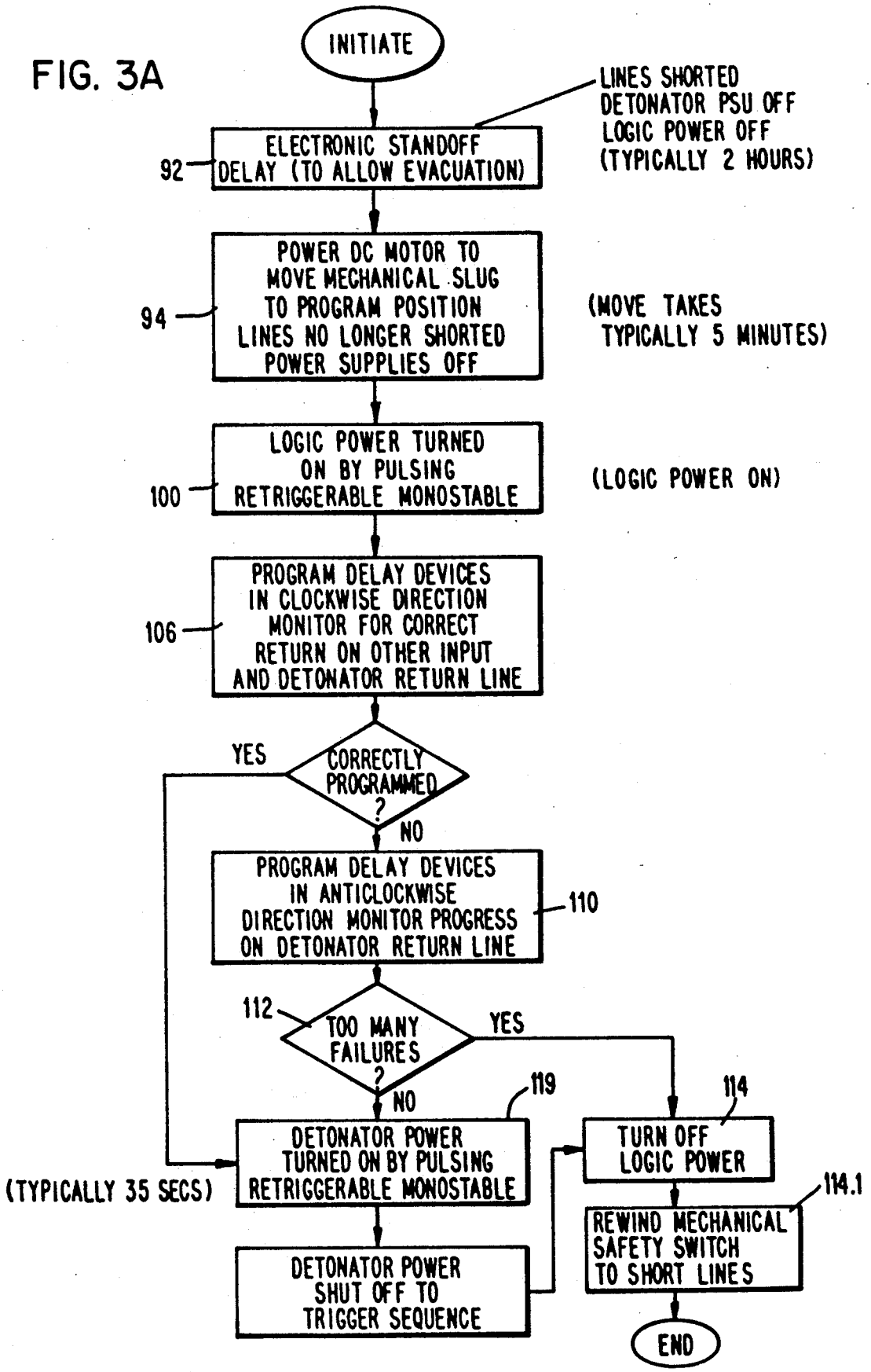
FIG. 3A shows a flowchart of the steps involved in activating the controller and programming delay devices of the first embodiment of the invention.

The operation of the controller 12 will now be described with reference to FIGS. 3A, 3B, and 3C. Once the operator has connected the harness 14 to the controller 12, he subsequently turns on the key switch 31, thereby bringing the safety level down from level 5 (the safest level) to level 4, as is indicated in FIG. 3C. The controller 12 remains dormant until the operator has selected the appropriate timing pattern (i.e. the delay times to be programmed into each one of the delay devices, and the number of such devices which are to be programmed), by operating the appropriate selector switch 42, and an ARM switch 90, causing the clock 44 to commence timing for a stand-off time period which is typically two hours (refer to both block 92 of the flow chart, and to step 4 of FIG. 3C). After this time has elapsed, the motor 80 will be actuated to move the slug away from the disabled position in the direction of arrow 87, thereby connecting the harness lines 14 to the controller 12, as can be seen in block 94 of the flow chart, and step 5 of FIG. 3C.

Figure 3B:
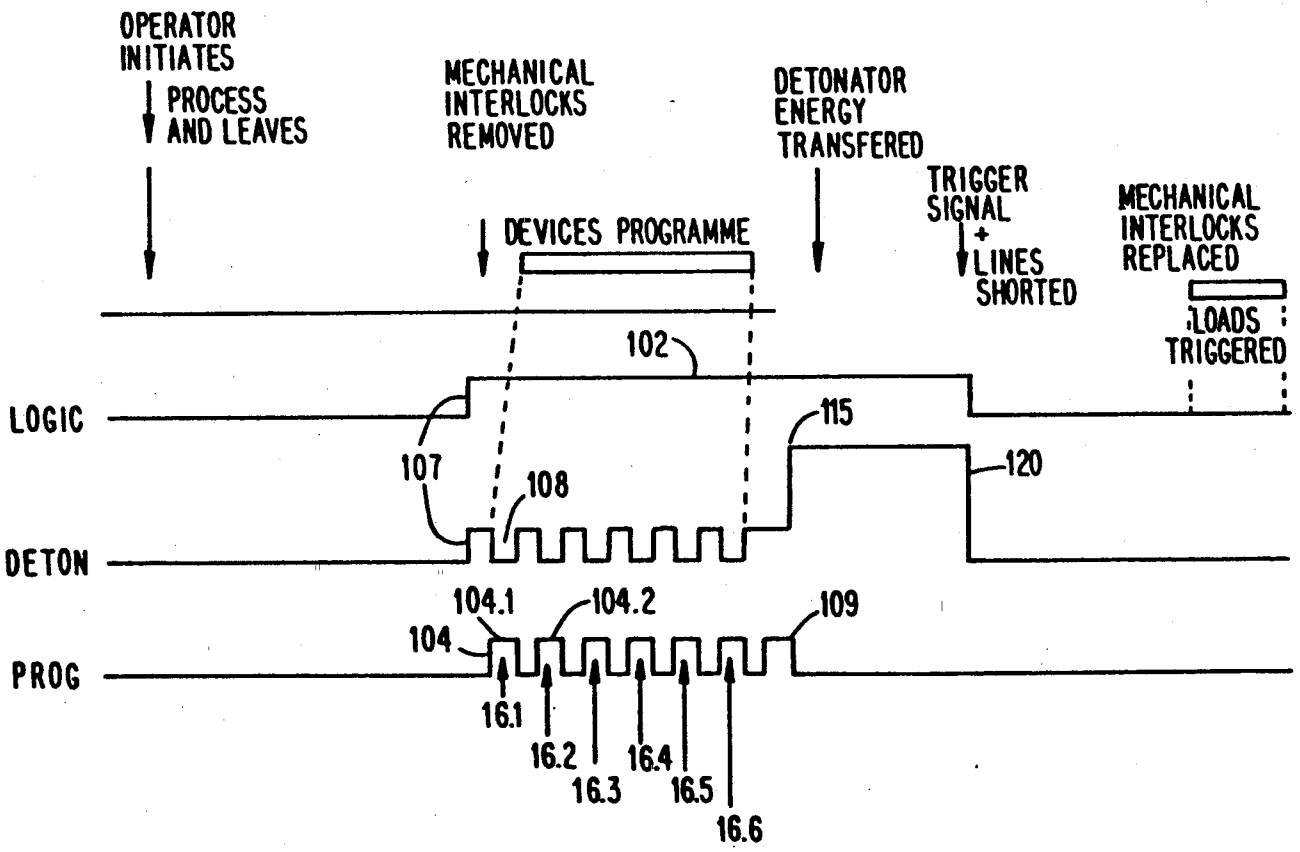
FIG. 3B shows a timing diagram equivalent of the flowchart of FIG. 3A.

The LOGIC line is then raised by sending a pulsed signal from the microcomputer to a retriggerable monostable 96, which in turn actuates a logic power supply 98 to power up the LOGIC line 64 (see block 100 of the flow chart, as well as the rising edge of LOGIC pulse 102 in FIG. 3B). The retrigerrable monostable 96 requires a regular pulse train from the microcomputer 28 to hold the LOGIC power supply 98 on. Thus, should the microcomputer 28 fail, it will no longer supply a regular pulse train to the monostable 96, causing the logic power supply 98 to turn off, and lower the LOGIC line 64.

A signal from the microcomputer 28 along enable line 54 then enables the buffer 50, thereby allowing programming of the delay devices 16.1 to 16.6 to commence by raising at 104 the PROG A line 46 (see block 106). The programming of each of the delay devices 16.1 to 16.6 is monitored by observing the return signals on the DETONATOR line 62, which at this stage is in high impedance mode, so as to permit feedback. The return signal 108 appearing on the DETONATOR line 62 indicates when the delay device 16.1 has commenced timing, and the PROG A line is pulled low to indicate the end of the timing period in which a first timing signal 104.1 is programmed into the first delay device 16.1, causing the DETONATOR line to be raised. The following timing signal 104.2 is transferred to the next delay device 16.2. The actual delays to be programmed are drawn from the blast pattern stored in the ROM look-up tables 40, and the programming procedure is repeated until all the delay devices 16.1 to 16.6 have been programmed.

Once all the delay devices have been programmed, an additional pulse 109 is sent via the PROG A line. Since all the delay devices have been programmed, this additional pulse is transmitted through all the delay devices and is received at the PROG B I/O port 60. Upon the reception of the additional pulse 109, the controller assumes that all the delay devices were programmed correctly and raises the DETONATOR line 62 (at 115) by switching on the detonator power supply 116. This charges the energy stores or capacitors in the delay devices, as will presently be described. The detonator power is then turned off, the falling edge 120 acting as a trigger for all the delay devices to begin timing their respective delay times.

If, during programming via the PROG A line, a discontinuity is detected by the lack of a return signal via the DETONATOR line, the controller continues to send out the programming pulses until all the delay devices still linked to the controller via the PROG A line have been programmed. An additional pulse is still sent out via the PROG A line and the PROG B I/O port 60 is monitored for the return pulse. The lack of a return pulse confirms the discontinuity.

In response thereto, the controller disables the PROG A buffer 50 and enables the PROG B buffer 52. The programming procedure is completed via the PROG B line 48 in the anti-clockwise direction by the controller drawing the timing pattern out of the ROM table in the reverse order. This procedure can be seen more clearly in FIG. 5B, in which the PROG A line is low and timing signals 104.6, 104.5 and 104.4 are sourced in reverse order from the PROG B line for programming the respective delay devices 16.6 16.5 and 16.4.

The progress of programming the outstanding delay devices is once again monitored via the DETONATOR line. The number of delay devices to be programmed is preset into the ROM tables, and this number must correspond with the number of delay devices actually connected to the harness. It is thus possible to determine the span of the discontinuity by determining, via the DETONATOR line, how many delay devices have been successfully programmed. On the basis of the number of delay devices which have been successfully programmed (indicated by the number of feedback signals received on the DETONATOR line 62), the microprocessor 28 then ascertains whether the entire operation should be aborted or whether it should continue. For example, if only one of eight delay devices have not been programmed, then the operation may continue. If more than one delay device has not been programmed, the blasting procedure may be aborted by shutting off the LOGIC power, and rewinding the motor 80 to move the slug 86 to the disabled position, thereby shorting the lines to ground. (See blocks 112, 114 and 114.1).

As was described previously, once the delay devices have been successfully programmed, the DETONATOR line 62 is raised (at 115) by actuating a detonator power supply 116, which is turned on by means of a retriggerable monostable 118 fed by pulses from the microcomputer 28 (see block 119). As with the logic power supply 98, failure of the microcomputer will interrupt the pulse train and cause the detonator power supply 116 to turn off. Once all the capacitors in the delay devices 16.1 to 16.6 have been charged, the detonator power supply 116 will be turned off, thereby lowering the DETONATOR line at 120, the falling edge 120 acting as a trigger signal for the delay devices to commence timing their respective delay times. At the same time, the motor 80 is powered to move the slug 86 to the disabled grounded position 88 (see block 114.1), thereby grounding the harness lines, and returning the system to its initial state. A buzzer 12.1 is connected to the microcomputer 28, and it sounds whenever the switches are connected to the harness and the harness lines are unearthed.

Figure 4:
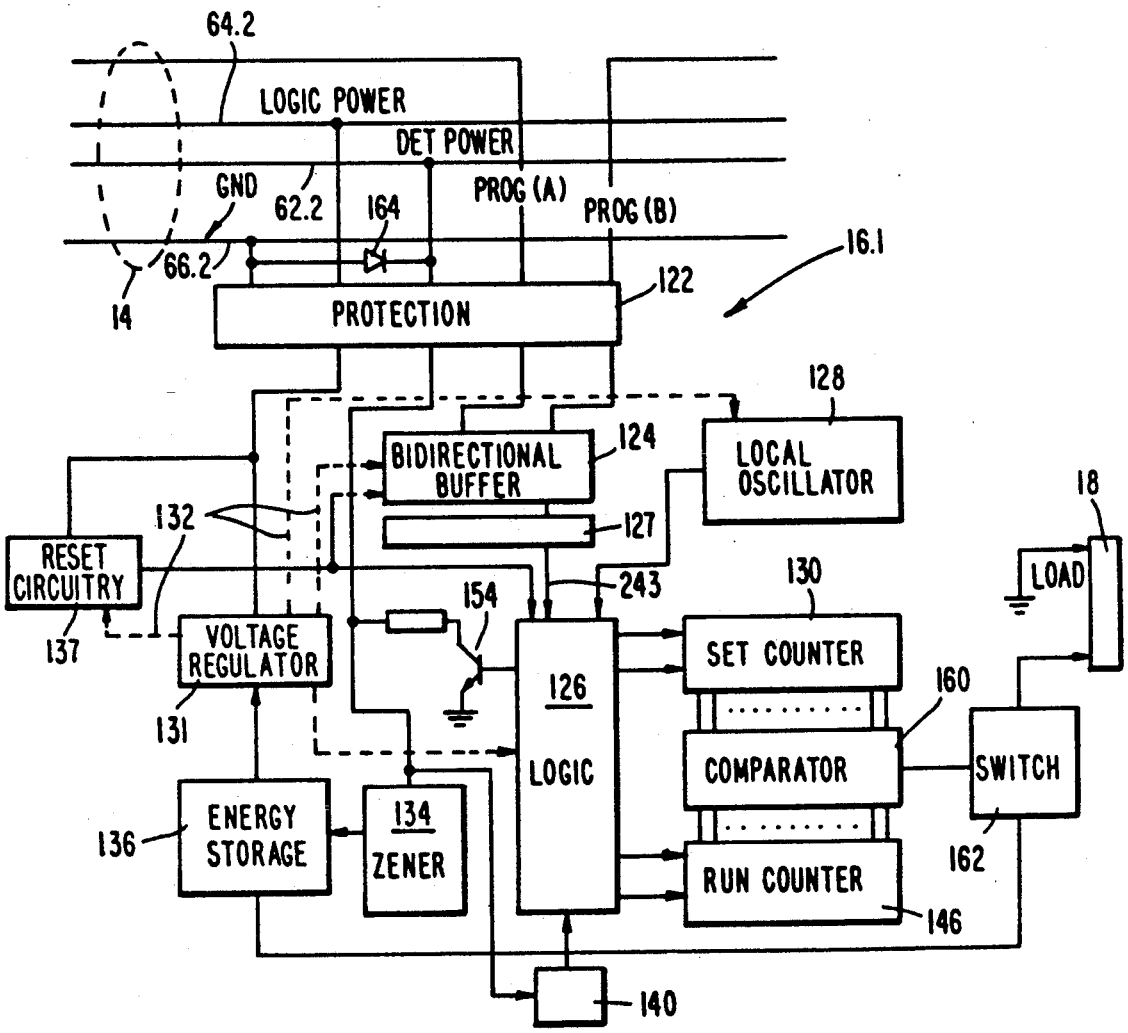
FIG. 4 shows a functional block diagram of a first embodiment of a delay device of the invention.
Figure 5A:
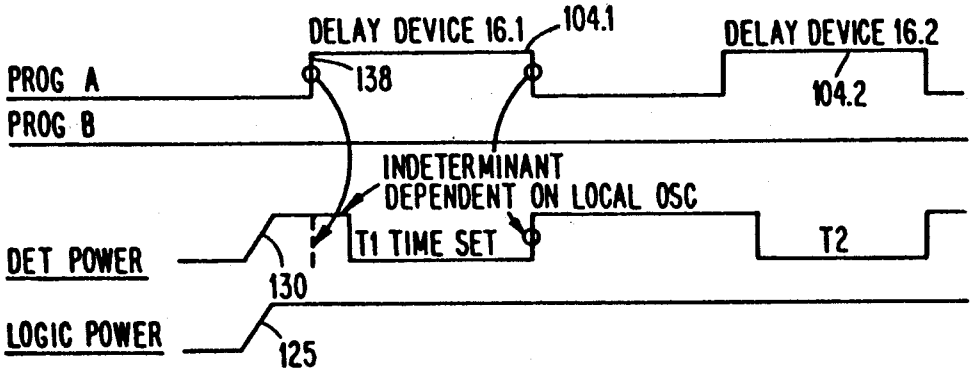
FIG. 5A shows a timing diagram of the output of the controller when programming in the clockwise direction.
Figure 5B:
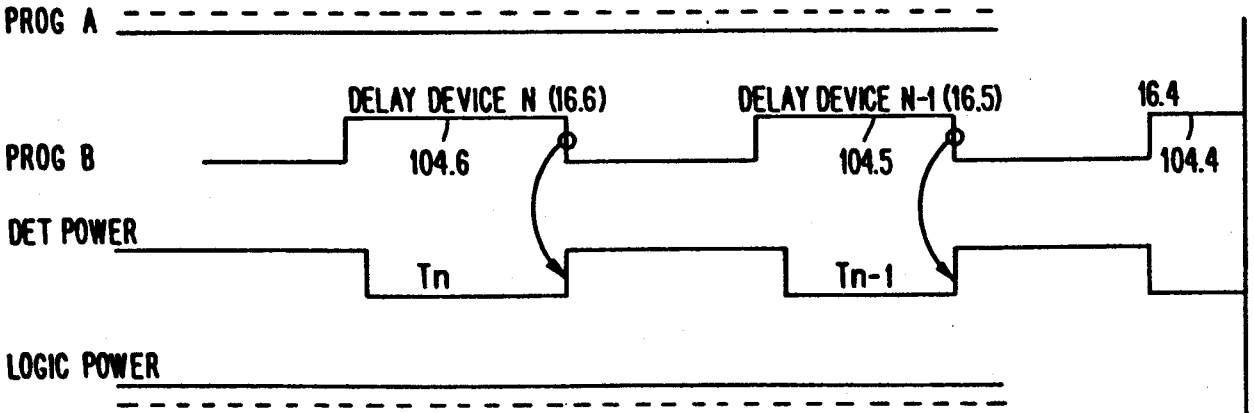
FIG. 5B shows a timing diagram of the output of the controller when programming in the anti-clockwise direction.
Figure 6:
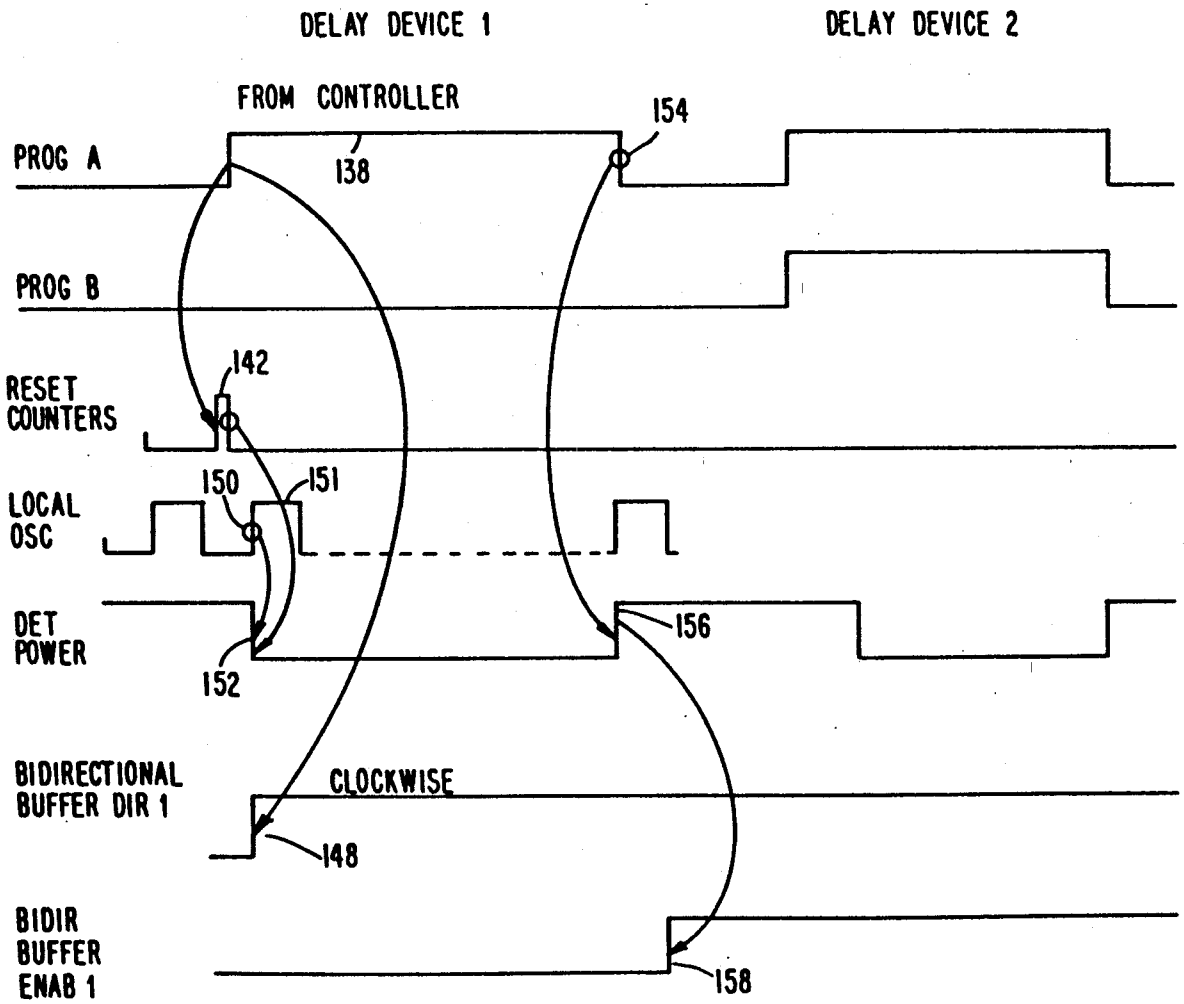
FIG. 6 shows a timing diagram illustrating how a reference timing signal is programmed into the delay device of FIG. 4.

Referring now to FIGS. 4, 5A and 6, the operation of the system will now be described with reference to the delay devices. The delay device 16.1 of FIG. 4 is connected in parallel via protective circuitry 122 between the GROUND line 66.2, the LOGIC or LOGIC POWER line 64.2, and the DETONATOR or DET POWER line 62.2, and is linked in series between the PROG A and PROG B lines. The latter two lines are connected to one other via a bidirectional buffer 124, which will be described in greater detail further on in the specification.

In broad terms, the delay device 16 has a logic unit 126 which receives a reference timing signal from either the PROG A or the PROG B line via the bidirectional buffer 124 and bidirectional buffer control circuitry 127. Onboard timing is provided by a local oscillator 128, which is used to increase a set counter 130.

Once the LOGIC line goes high at 125 in FIG. 5A, it powers up both the logic unit 126 and all other active components of the delay device 16.1 via a voltage regulator 131, as is indicated by broken lines 132 in FIG. 4. On being powered up via the voltage regulator 131, reset circuitry 137 generates a reset pulse to reset the logic unit 126 and to set up the bidirectional buffer 124 and its control circuitry 127. At the same time as the LOGIC line 64.2 is raised, the DETONATOR line 62.2 is pulled high at 130 to the level of the LOGIC line by means of a pull-up resistor 133 located in the controller 12 of FIG. 2. The voltage level of the DETONATOR line is limited to a level which does not permit zener diode 134, which is connected to an energy storage device 136, to conduct.

The logic unit 126 receives the timing signal 138 from the PROG A line via the bidirectional buffer 124 and its control circuitry 127. As a result of the PROG A line going high, the logic unit 126 transmits a reset pulse 142 to clear both the set counter 130 and a run counter 146. At the same time, a forward direction signal 148 is raised to disable the reverse buffers and only to permit passage of reference timing signals travelling in the forward direction, along the PROG A line. Further on in the specification, the operation of the bidirectional buffer 124 and its circuitry 127 will be described in more detail.

At the rising edge 150 of the first pulse 151 generated by the local oscillator 128 after the PROG A line has been raised, the logic unit 126 pulls the DETONATOR line low at 152 via an open collector transistor 154, thereby indicating to the controller 12 that it has started to generate a time period. Simultaneously, the local oscillator 128, starts to increment the set counter 130. The lowering at 152 of the DETONATOR line, which monitors the starting period of the set counter 130, is detected by the controller 12, which pulls low the PROG A line at 54 once the appropriate period has been clocked into the set counter 130 by the local oscillator 128. The DETONATOR line goes high at 156 in response to the PROG A line going low, causing the set counter 130 to freeze with the number of oscillations which have been clocked into it by the local oscillator.

In response to the DETONATOR line going high at 156, a bidirectional buffer enable line goes high at 158 so that the subsequent reference timing signal travelling along the PROG A line bypasses the delay device under discussion and travels to the next delay device in the series which requires programming, and for which the timing signal is intended. This routine is repeated successively with each delay device. Once all the delay devices 16.1 to 16.6 have been programmed, the voltage in the DETONATOR line is raised to a level above that of the zener breakdown voltage (see 115 in FIG. 3B) so as to charge all the capacitors 136 to enable them to independently power their respective delay devices 16.1 to 16.6. Once all the capacitors of the delay devices are fully charged, both the DETONATOR line and the LOGIC line (see 120 in FIG. 3B) are lowered to provide a trigger signal. The capacitor 136 then takes over the powering of the voltage regulator 131 where the LOGIC line left off to continue supplying the local oscillator 128, the set counter 130, the run counter 146 and the other active components of the delay device circuitry with power.

The trigger signal is received at the logic unit 126 via a voltage limiter 140, which limits the voltage of the trigger signal to the voltage levels acceptable by the logic unit 126.

On receipt of the trigger signal, the delay devices then commence timing the specific delay which has been programmed into each of their set counters 130 by using the local oscillator 128 to increment the run counter 146 via the logic unit 126. A comparator 160 actuates a switch 162 as soon as the value in the run counter 146 equals the value which has been stored in the set counter 130. Actuation of the switch 162 causes the remaining charge stored in the capacitor 136 to be discharged into the electrical load or detonator 18, thereby detonating the explosive charge.

If the GROUND line 66.2 leading to a delay device is broken or disconnected, then there is the possibility that the circuitry will float and perhaps even oscillate. This may then affect the PROG A and PROG B lines, which in turn may adversely affect the adjacent delay devices, in particular if the delay device oscillates, as this may cause the adjacent delay devices to be programmed with spurious signals. A diode 164 is thus placed between the DETONATOR and GROUND lines of each delay device to ensure that, during the programming phase, should the GROUND line to that delay device be disconnected it will be held at a level governed by the DETONATOR line.

Figure 7:
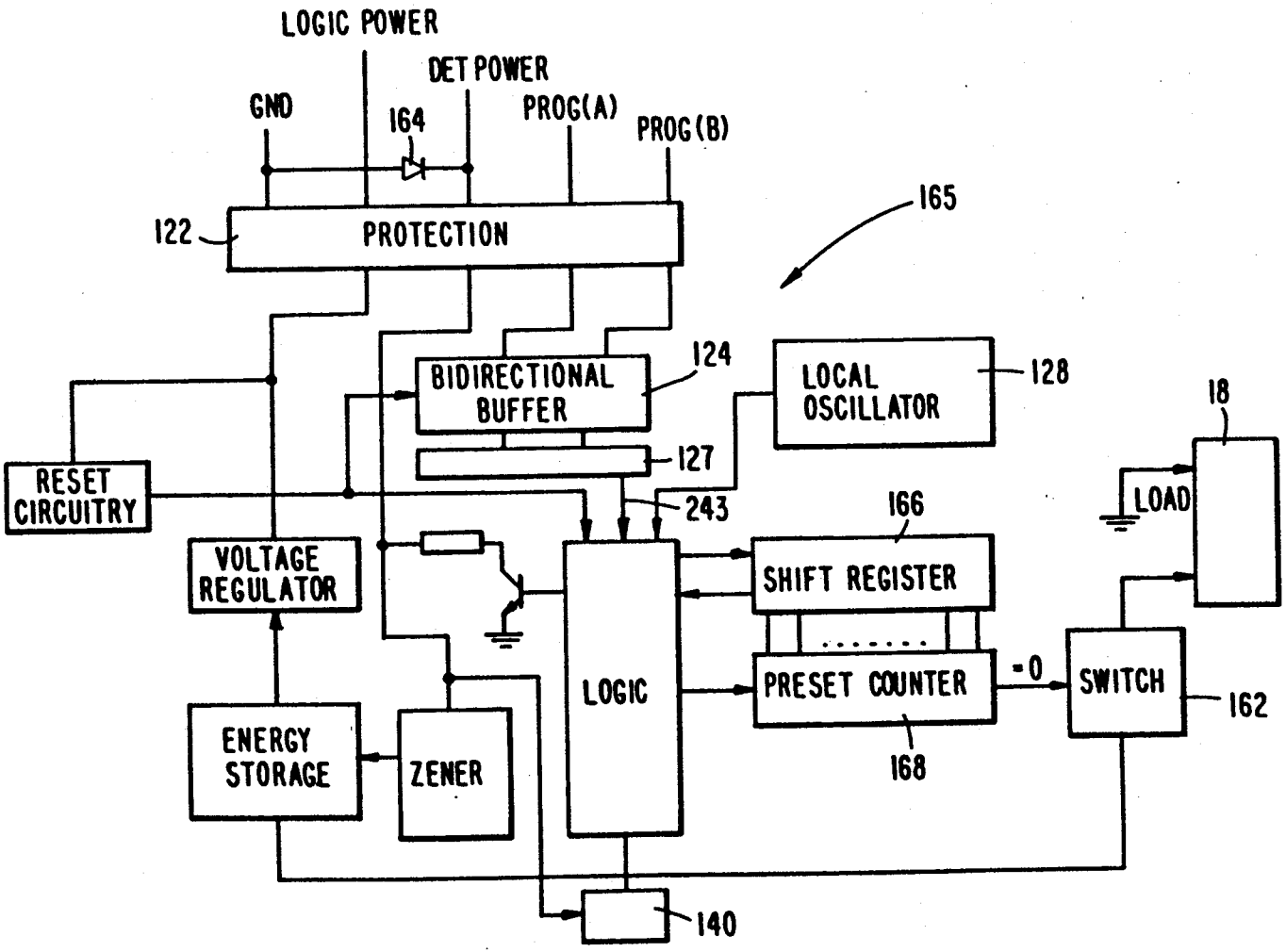
FIG. 7 shows a functional block diagram of a second embodiment of a delay device of the invention.
Figure 8:
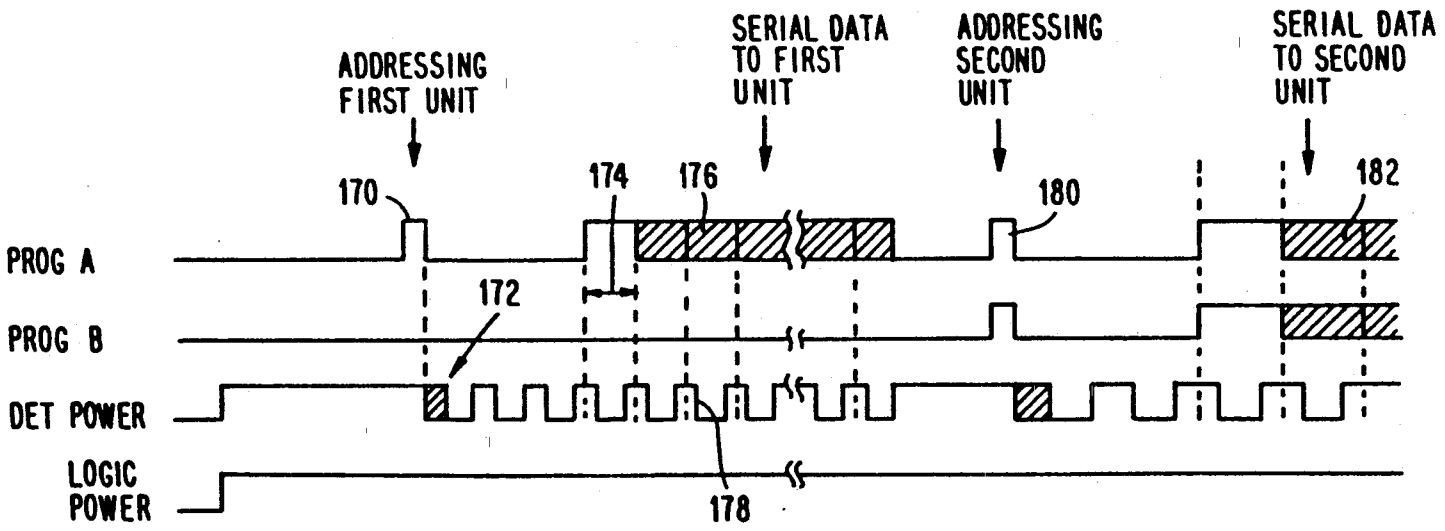
FIG. 8 shows a timing diagram illustrating how a reference timing signal is programmed into the delay device of FIG. 7.

Proceeding now to FIG. 7, a second embodiment of a delay device 165 is shown, in which components similar to those in FIG. 4 are indicated with the same numerals. The comparator 160, set counter 130 and run counter 146 of FIG. 4 are replaced with a shift register 166 and a preset counter 168. The operation of the delay device 165 will now be described with reference to the associated timing diagram in FIG. 8.

The programming routine is initiated by sending a positive address pulse 170 along the PROG A line. The delay device 165 detects this pulse and responds by sending a return signal 172 to the controller along the DET POWER line which is proportional to the signal from its local oscillator 128. The period 174 of the signal is then measured accurately by the controller 12 by means of a crystal-controlled oscillator which operates in the MHz range. The controller then proceeds to calculate the precise value that must be loaded into the shift register 166 of the delay device in order to obtain the correct delay time. If, for example, a 12 millisecond delay is required to be programmed into the delay device, and the period of its local oscillator is measured by the crystal-controlled oscillator to be 1.5 milliseconds, then the microcomputer will calculate that a digital word representing eight periods of the local oscillator (i.e. 1 0 0 0) is required. The digital word 176 representative of such delay is then transmitted serially to the delay device along the PROG A line, using the local oscillator signal 178 as a clock signal for the serial transmission.

Once the digital word 176 has been received by the delay device, it is loaded into the shift register 166. The bidirectional buffer 124 is set so that all the information along the PROG A line bypasses the first delay device and is relayed on to the next delay device in the series, which is addressed with a second pulse 180 along the PROG A line and subsequently supplied with a second digital word 182. This process is repeated until all the delay devices are programmed. Once the DET POWER line is lowered at 120, the digital data stored in the shift register 166 of the delay devices is then transferred in parallel to the preset counter 168. The preset counter 168 then proceeds to count down, and as soon as the preset counter reaches zero, the switch 162 is actuated and the detonator is triggered as described previously.

An advantage of this embodiment is that the actual frequency of the local RC oscillator 128 is used to program the delay device. As the frequency of the local oscillator is dependent on temperature and component tolerances, it varies in respect of each delay device. The digital word sent by the controller to each delay device compensates for such variations caused by these differences and allows the delay time to be set very accurately using a relatively inexpensive RC oscillator, provided such an oscillator is stable. Furthermore, by transmitting a digital word rather than a real time signal, the time taken to program all the delay devices is completely independent of one or more of the actual delay times programmed into each delay device. In fact, the programming time is generally reduced, thereby lessening the period for which the harness lines are unearthed, and potentially unsafe.

Figure 9:
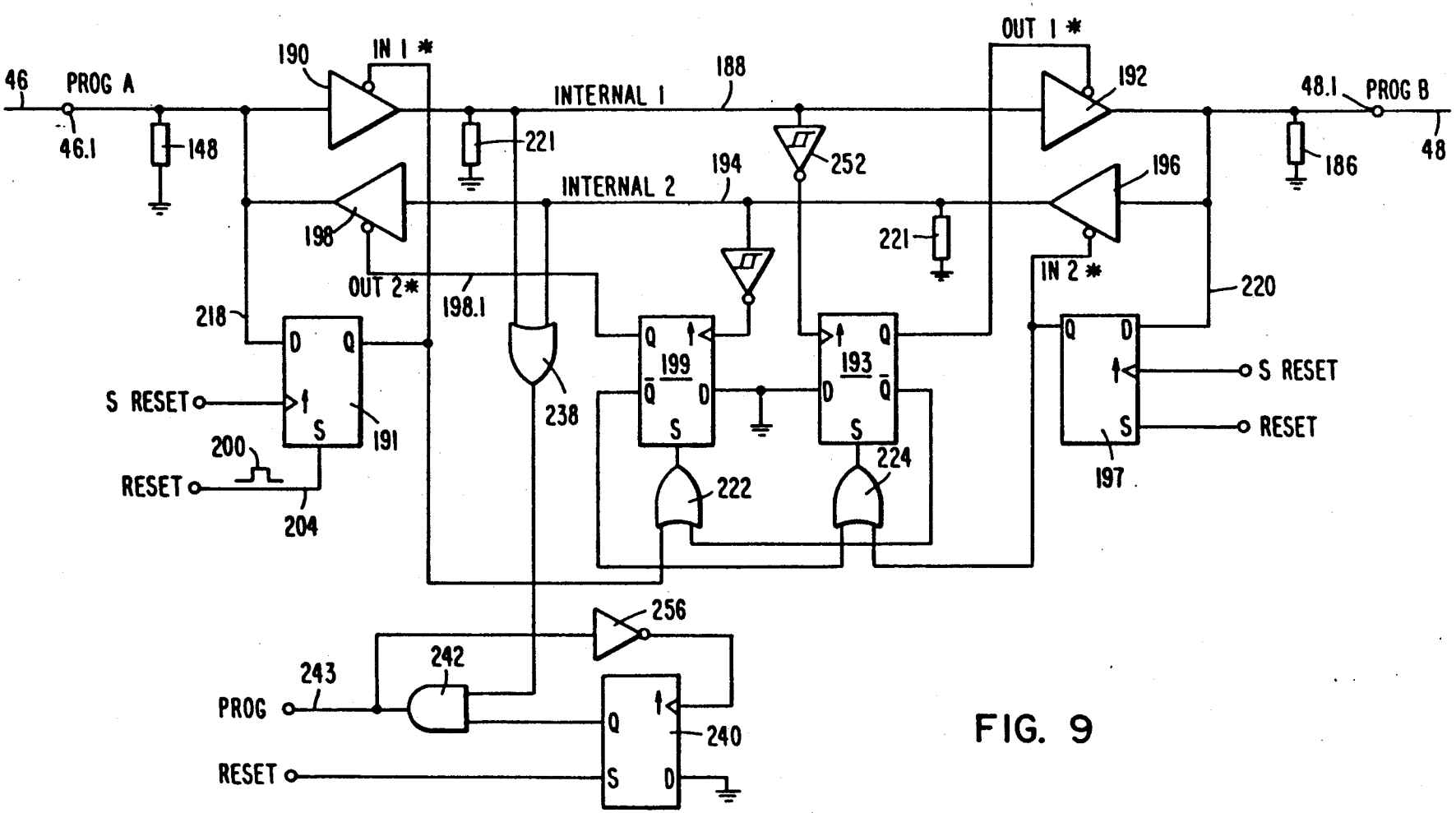
FIG. 9 shows a schematic circuit diagram of a bidirectional buffer forming part of the delay devices of FIGS. 4 and 7.
Figure 10:
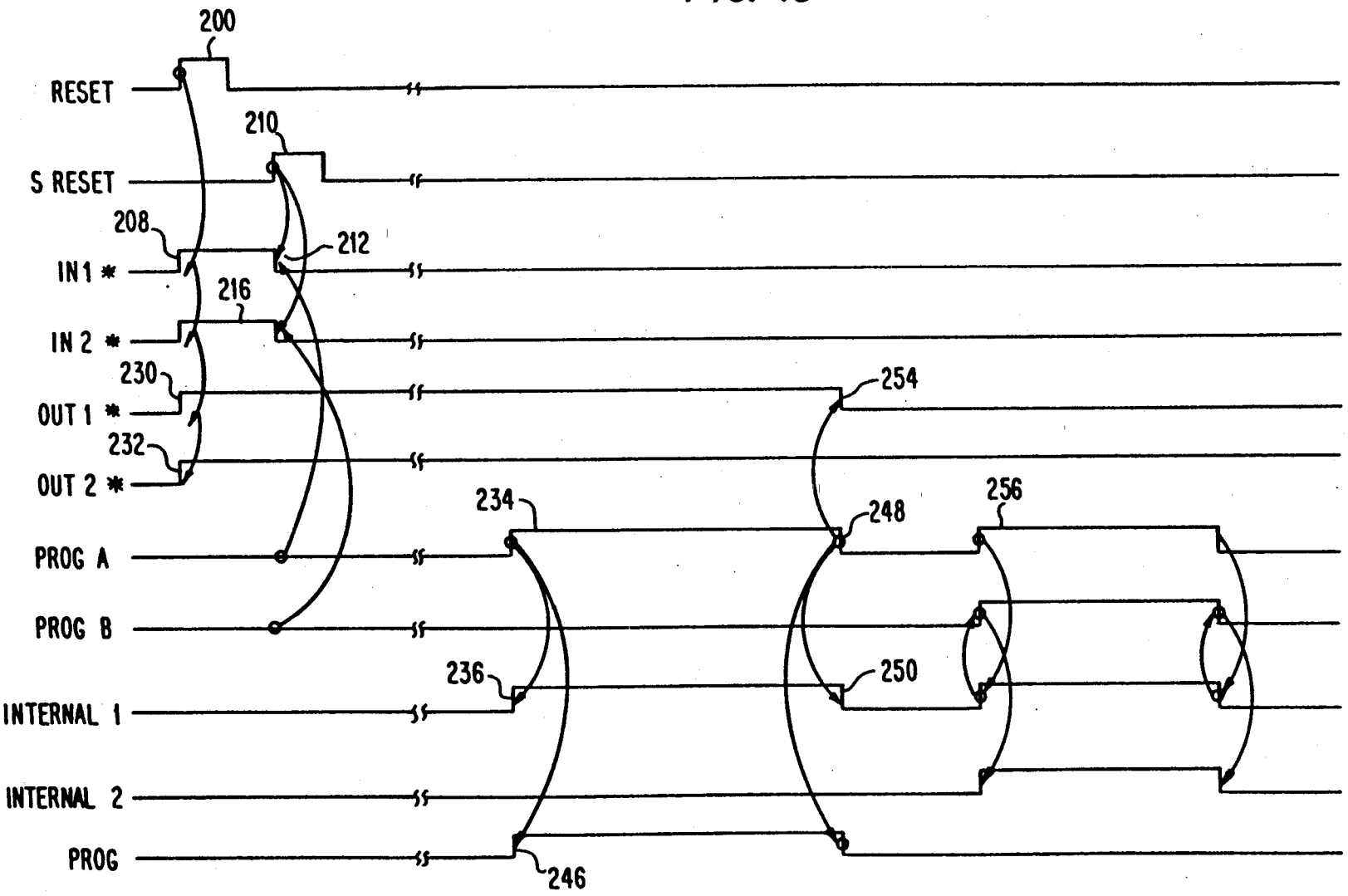
FIG. 10 shows a timing diagram illustrating the operation of the bidirectional buffer of FIG. 9.

The operation of the bidirectional buffer 124 and it control circuitry 127 will now be described in greater detail with reference to FIGS. 9 and 10. Under normal operation, terminals 46.1 and 48.1 to which the PROG A and PROG B lines 46 and 48 are connected, are pulled to ground by means of pull down resistors 184 and 186 respectively. The PROG A terminal 46.1 is joined to an INTERNAL 1 bus 188 via a forward input buffer 190 which is controlled by a signal IN1* originating from the Q output of flip-flop 191. The INTERNAL 1 bus 188 is in turn connected to the PROG B terminal 48.1 via a forward output buffer 192 controlled by a signal OUT1* originating from the Q output of flip-flop 193. The PROG B terminal 48.1 is connected to an INTERNAL 2 bus 194 to receive timing signals in the reverse direction via a reverse input buffer 196 which is controlled by a control signal IN2* sourced from the Q output of flip-flop 197. The INTERNAL 2 bus is connected to the PROG A line 46 via a reverse output buffer 198 which is controlled by a control signal OUT2* emanating from the Q output of flip-flop 199.

Once power is applied to the delay device by raising the LOGIC line (see 125 in FIG. 5A), the logic unit 126 generates a RESET pulse 200 which travels along an input line 204 connected to the set input of flip-flop 191, causing the Q output of the flip-flop 191 to go high, thereby raising the IN1* signal at 208 and disabling the forward input buffer 190 to prevent the passage of reference timing signals along the PROG A line to the INTERNAL 1 bus 188. The logic unit 126 then generates an S RESET pulse 210 at the clock input of the flip-flop 191, causing the signal level at the D input, which is connected to the PROG A line, to be clocked through to the Q output. As, under normal conditions, the PROG A line would be low at this stage, the IN1* signal is lowered at 212 to enable the input buffer 190 and to allow timing signals to travel along the PROG A line 46 to the INTERNAL 1 bus 188. The flip-flop 197 is also controlled by the RESET and S RESET signals from the logic unit 126 in an identical fashion to the flip-flop 191, the pulse 216 IN2* emanating from the Q output of the flip-flop 197 being identical to the pulse 208. The reverse input buffer 196 is thus disabled and subsequently enabled in exactly the same manner as the buffer 190, initially preventing and subsequently permitting the passage of reference timing signals along the PROG B line 48 through to the INTERNAL 2 bus 194.

During the period when the IN1* and IN2* signals are high, and the input buffers 190 and 196 are disabled, the logic level of the PROG A and PROG B lines 46 and 48 are continuously monitored by being linked via monitoring lines 218 and 220 to the D inputs of the flip-flops 191 and 197. Thus, should the logic level of the PROG A or PROG B lines go high during this period as a result of either of them being shorted to high, the Q outputs will be held high after being clocked through by SRESET pulse 210 and the input buffers 190 and 196 will be permanently disabled to prevent any spurious signals from entering the INTERNAL 1 and INTERNAL 2 buses, and from being programmed into the delay device. At this stage, the INTERNAL 1 and INTERNAL 2 buses are pulled to ground by pull-down resistors 221.

The rising edge of RESET pulse 200 also causes the outputs of OR gates 222 and 224, connected to the SET inputs of flip-flops 193 and 199 to go high, thereby raising the OUTl* and OUT2* signals at 230 and 232. This has the effect of disabling the output buffers 192 and 198, thereby preventing programming signals from passing through the delay device, and preventing spurious signals generated at the delay device from being transmitted to an adjacent delay device via the sensing lines 218 and 220.

Provided both the PROG A and PROG B lines are low on the rising edge of the S RESET pulse 210, both input buffers 190 and 196 are enabled as a result of the IN1* and IN2* signals going low, thereby allowing free access for timing signals travelling along the PROG A or PROG B lines to the respective INTERNAL 1 and INTERNAL 2 buses. The bidirectional buffer is thus ready to receive a timing signal, whether it arrives along the PROG A or PROG B line. Should a reference timing signal 234 arrive at the PROG A terminal 46.1 in which case programming is occurring in the clockwise direction, the INTERNAL 1 line 188 will also be raised at 236 as the input buffer 190 is enabled. This will cause the output of OR gate 238 to go high. In view of the fact that the RESET pulse 200 has already caused the Q output of flip-flop 240 to be held high, the output of AND gate 242, namely the PROG line 243, will go high at 246 in response to its input from the OR gate 238 going high. On completion of the timing signal 234 from the controller, signified by the PROG A line being lowered at 248, the INTERNAL 1 line will be lowered at 250. This will cause a positive signal to travel via NOT gate 252 to the clock input of flip-flop 193, thereby clocking in the grounded D input level so as to lower the OUT1* signal at 254 to enable the forward output buffer 192, and to connect the INTERNAL 1 bus 188 to the PROG B line 48.

At the same time, the flip-flop 240 will toggle as a result of the output of the AND gate 242 going low after the output of OR gate 238 has gone low. The output from the AND gate 242 is fed back via an inverter 256, thereby holding the Q output of the flip-flop 240 at zero and preventing any further programming information from being fed to the delay device via the PROG line 243.

The OR gates 222 and 224, which have one of their inputs connected to the Q* outputs of opposite flip-flops 193 and 199 respectively, prevent the flip-flop 199 from enabling the output buffer 198 when programming is occurring along the PROG A line, and also prevent the flip flop 193 from enabling the output buffer 192 should timing signals be travelling in the opposite direction, along the PROG B line.

The PROG line 243 is used to convey the programming signal 246 which programs the delay device via the logic unit 126, as has been described previously with reference both to FIG. 4 and to FIG. 7.

When the next pulse 256 arrives along the PROG A line, both the input buffer 190 and the output buffer 192 are enabled, which allows the pulse 256 to ripple through the buffers 190 and 192, thereby bypassing the delay device under discussion and continuing along the PROG B line to the next delay device which requires programming. Under normal conditions, the pulse 256 will be the first pulse travelling along the PROG B line 48, and it will thus be programmed into the next delay device in the manner described.

Should break in the harness 14 occur, as has been discussed previously, before programming of the delay device under discussion has occurred, timing signals are rerouted by the controller in the manner previously described in the opposite direction from the I/0 port 60 along the PROG B line. Programming in the reverse or anti-clockwise direction along the PROG B line occurs in exactly the same manner as has been described with reference to the PROG A line, as the circuitry of the bidirectional buffer 124 is totally symmetrical.

Figure 11:
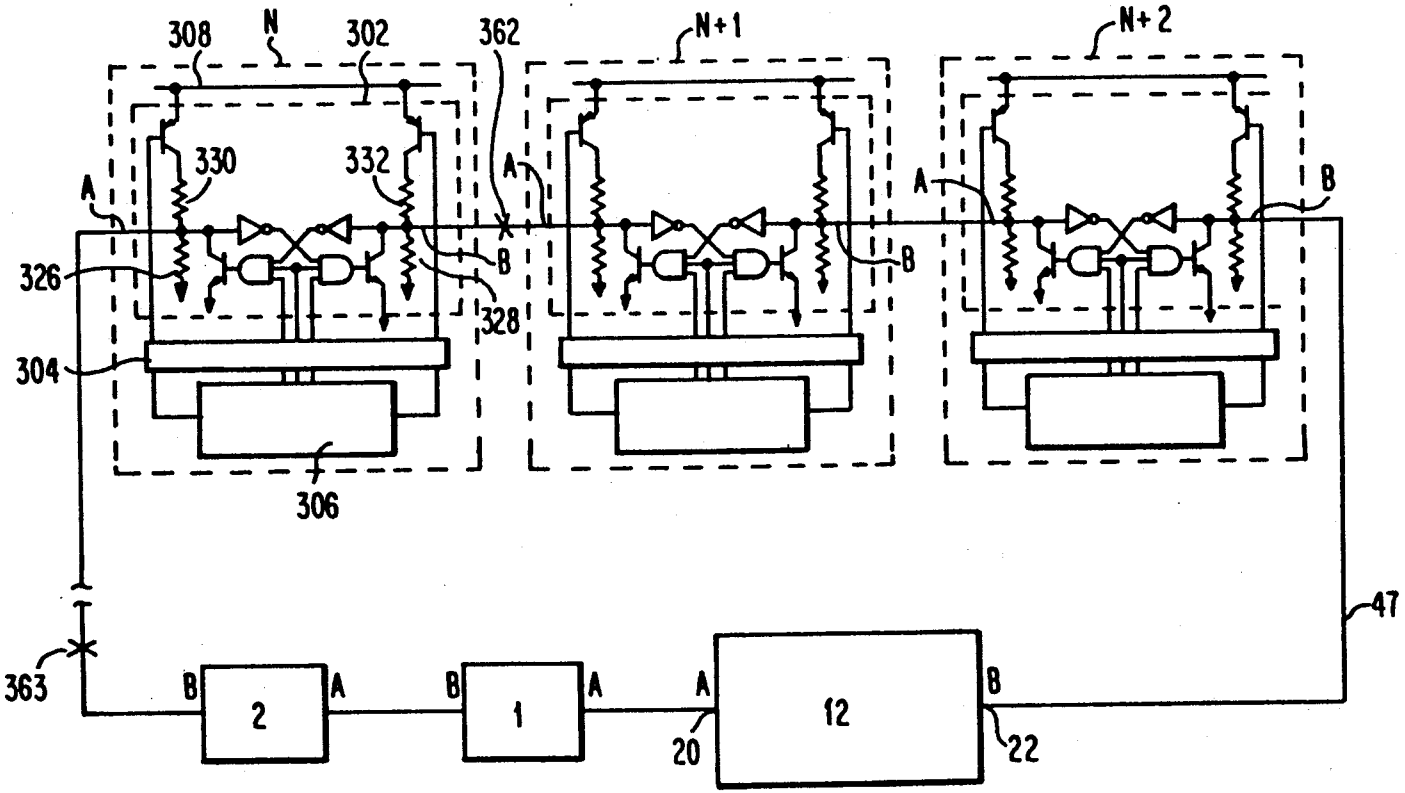
FIG. 11 shows a schematic view of a third embodiment of the timing apparatus of the invention showing a series of delay devices of the invention which, incorporate bidirectional buffers.

Referring now to FIG. 11, an alternative embodiment of the bidirectional buffer and its logic circuitry is shown in which a series of delay devices 1,2, . . . N, N+1 and N+2 incorporating this embodiment are connected in series to the A and B ports of a controller 12. For clarity of illustration, only the PROG line 47 of the harness 14 is shown. Each delay device 1 to N+2 includes a bidirectional buffer 302, the operation of which is controlled by buffer logic circuitry 304, which is illustrated in more detail in FIG. 12. The buffer logic circuitry 304 is in turn connected to the remainder of the delay device circuitry 306, which may resemble that illustrated in either one of the two embodiments of FIGS. 4 and 7.

Figure 13A:
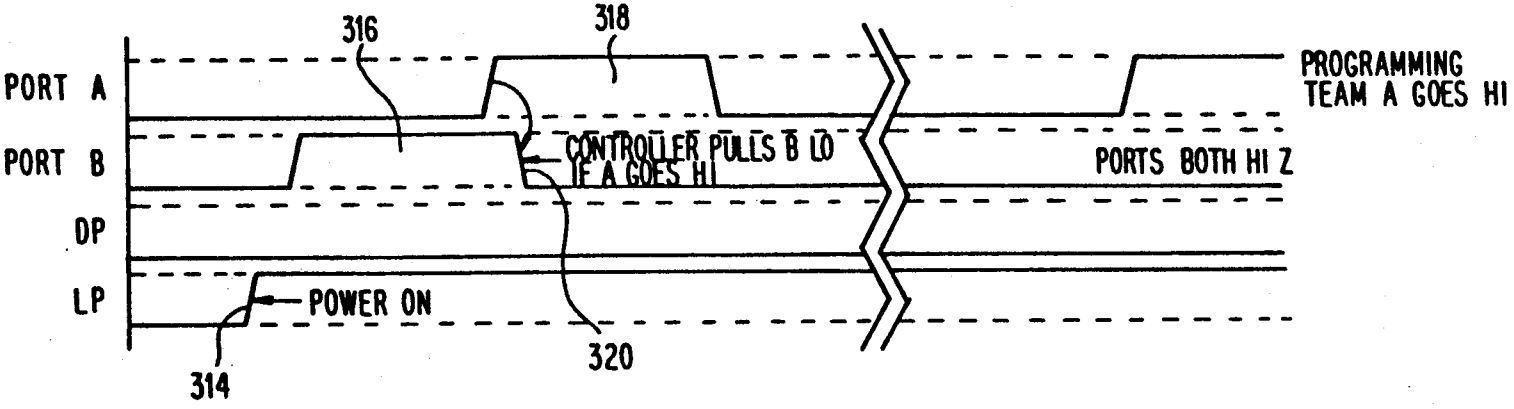
FIGS. 13A and 13B show timing diagrams illustrating the manner in which the programming direction in respect of the timing apparatus of FIG. 11 is set up for respective unbroken and broken harnesses.

The basic steps involved in the setting up and programming of the timing apparatus are as follows:

Initially, as is illustrated in FIG. 13A, the LOGIC line 64 is raised at 314, thereby powering up a regulated internal 5 volt power supply line 308 for supplying power to the bidirectional buffers 302 and the buffer logic circuitry 304. The delay devices 1 to N+2 have respective PROG A and PROG B terminals. The PROG A terminals receive timing signals travelling in a clockwise direction along the PROG line 47 from the A port 20 of the controller 12, and the PROG B terminals receive timing signals travelling in the anti-clockwise direction from the B port 22 of the controller 12. For the sake of simplicity, only three delay devices are shown in detail in FIG. 11; three hundred or more delay devices may be connected together in a practical implementation of the timing apparatus.

After the internal power line 308 has been raised by the logic line the controller 12 transmits a test signal 316 from the B port 22. If there are no breaks in the harness 14, the test signal 316 ripples through the delay devices in an anti-clockwise direction, and is received at port A of the controller after a short delay, as is illustrated by pulse 318. In response to receiving the pulse, the controller 12 pulls the B port low, as is shown at 320. This in turn causes a "0" to propagate through the delay devices in the anti-clockwise direction, the presence of a "0" at the respective B terminals of the delay devices 1 to N+2 indicating that programming should occur in the clockwise direction.

Figure 13B:
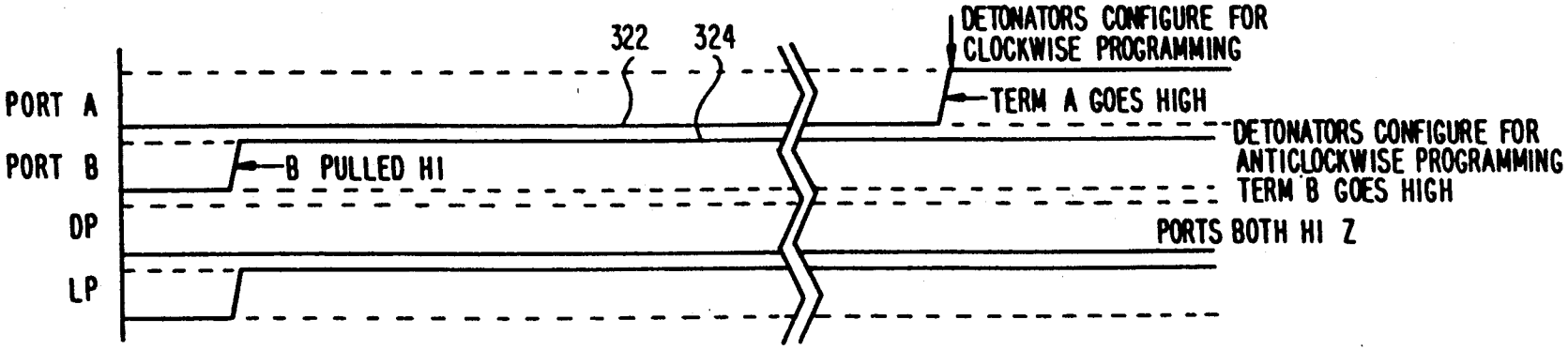

By monitoring its port A, the controller 12 can determine whether there is a break in the harness 14 or not. If port A receives a high input, as a result of the test signal 318, then there is no break in the harness 14, and the system is probably undamaged. However, if the input at port A remains low, as is shown at 322 in FIG. 13B, then this indicates that the harness 14 is broken; some of the delay devices will therefore need to programmed in the clockwise direction, and some in the anti-clockwise direction. As the controller 12 does not receive the test signal 318 at its port A, it holds the test signal emanating from port B high as is shown at 324, thereby indicating that at least some of the delay devices should be programmed by means of timing signals emanating from port B.

The manner of operation of both the bidirectional buffer 302 and the buffer control logic circuitry 304 will now be described in more detail with reference to FIGS. 12, 13C, 13D and 14.

Both the A and B terminals of each delay device have respective pull-down resistors 326 and 328 linked to earth and respective pull-up resistors 330 and 332 connected to the internal power line 308 via respective first and second controlled switches 334 and 336, which are in the form of pnp transistors. When turned on, controlled switches 338 and 340, which are in the form of npn transistors, link the A and B terminals directly to earth. On powering up of the delay device, a reset signal emanating from reset circuitry 137 in FIGS. 4 and 7 resets the D-type flip-flops 341, 342 and 344, thereby causing flip-flops 344 and 346 to be set with their Q outputs high and flip-flops 341, 342 and counter 348 to be reset with their Q outputs low. As a result, AND gate 350 will have a low output, and OR gate 351 will have a high output, thereby turning off the transistors 340 and 336 respectively. The transistors 334 and 338 will cause the output at terminal A to follow the input at terminal B as follows. If terminal B is low, it will be inverted by inverter 352 so as to provide a high input for AND gate 353. As both of the other inputs of AND gate are latched high, a high output from the AND gate 353 will turn on the transistor 338. A low input from terminal B will also be inverted by inverter 354, resulting in a high output from OR gate 356, which in turn causes a high output at OR gate 358 via AND gate 360, thereby turning off pnp transistor 334.

If, on the other hand, terminal B is high, transistor 334 will switch on and transistor 338 will switch off by opposite action of the same gates, thereby causing the high signal at terminal B to propagate through to terminal A. The arrangement of transistors, resistors, the AND gates 350 and 353 and the inverters 352 and 36 constitute the bidirectional buffer circuitry in this embodiment.

A high signal at port B of the controller 22 will be propagated in the anti-clockwise direction from the B to the A terminals of the delay devices in the manner described, only failing to reach the A port 20 if there is a break in the harness 14. Whenever a break in the harness 14 occurs, for example at 362, the resistor 328 of the delay device N whose B terminal is adjacent the break, and which is consequently disconnected from the adjacent delay device N+1, will cause the B terminal to be pulled down, thereby causing a low signal to be propagated back via delay devices N . . . ,2 and 1 to port A of the controller 12, as can be seen at 322 in FIG. 13 B, resulting in the output at port B remaining high, as is indicated at 324.

As was described previously, if no faults are detected, the controller 12 then lowers port B, the low signal being rippled through all the delay devices in the anti-clockwise direction to become a low at the A port, thereby setting up the harness 14 for programming in a clockwise direction, as will become apparent further on in the specification.

Figure 12:
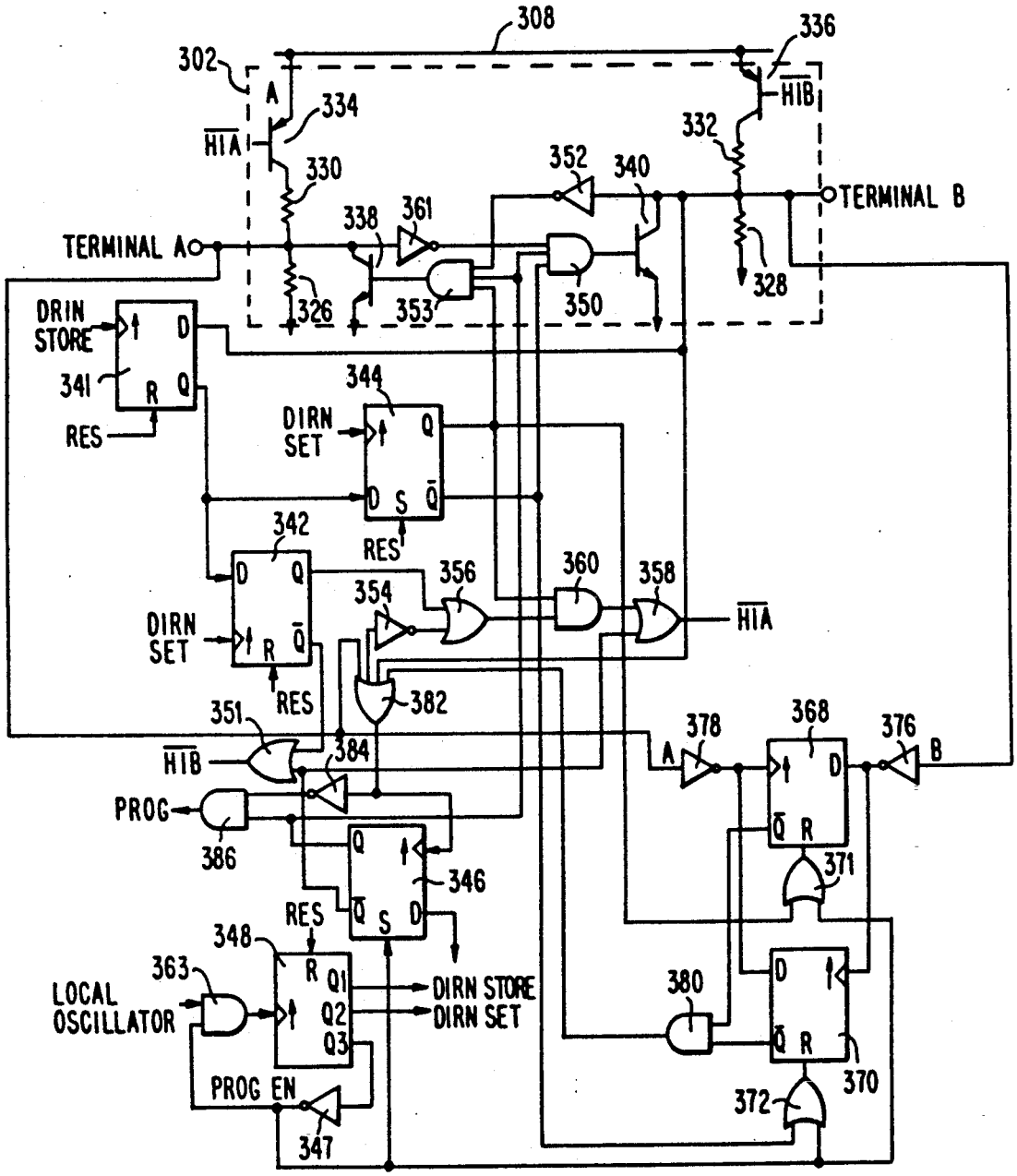
FIG. 12 shows a circuit diagram of the bidirectional buffer and the buffer logic circuitry of the delay devices of FIG. 11.

On powering up of the delay device N of FIG. 12, the local oscillator 128 provides a clock signal via AND gate 363 to the clock input of the counter 348, causing the Q1 output of the counter to provide a high DIRN STORE signal after a period of approximately 10 milliseconds, once it has been established by means of the test signal during which time period it has already been established whether there is a break in the harness or not, and all the terminals of the delay devices have settled. The DIRN STORE signal is in turn transmitted to the clocked input of flip-flop 341, clocking the level at terminal B into the Q output of flip-flop 341. After a further delay of approximately 10 milliseconds, a DIRN SET signal emanating from the Q2 output of counter 348 clocks in the level at terminal B, as stored in flip-flop 341, into flip-flops 342 and 344. If terminal B was low, then transistor 338 would be held off due to the AND gate 353 receiving a low input from the Q output of flip-flop 344.

The low output at AND gate 360, one input of which is fed from the low Q output of flip-flop 344, results in a low output at OR gate 358. This low output in turn causes transistor 334 to be turned on, raising terminal A and thereby enabling it to receive negative-going programming signals which originate from port A of the controller 12.

The transistor 336 is turned off via a high output from OR gate 351 as the Q* output of the flip-flop 342 is high due to the low D input thereof, which has been clocked in by the DIRN SET signal. Transistor 340 is still free to switch, depending on the input level at terminal A. If terminal A is low, terminal B would be pulled low as transistor 340 would be turned on via the AND gate 350, whereas if terminal A was high, transistor 340 would be turned off, thereby releasing terminal B and allowing it to be pulled up by terminal A of the adjacent delay device. Therefore, those delay devices which have their B terminals low before arrival of the DIRN SET and DIRN STORE signals are set up with their transistors 334 on, thereby pulling up their A terminals and enabling negative-going programming pulses to be transferred to their B terminals.

If, on the other hand, terminal B had been high when the PROG line 47 on the harness 14 had "settled", this would indicate that there was a break 362 in the harness 14 between the delay device N+1 and port A of the controller 12. After DIRN SET goes high, transistor 336 is turned on via OR gate 351, transistor 334 is turned off via a high signal from AND gate 360 and OR gate 358, and transistor 340 is turned off via a low signal from AND gate 350. The bidirectional buffer 302 would thus be set up with a configuration that is the reverse of that just previously described. The B terminal of the delay devices N+1 and N+2 would be pulled high, ready to receive negative-going programming signals in the anti-clockwise direction. On receipt of a negative-going programming signal at terminal B of delay device N+2 from port B, transistor 338 of the delay device N+2 is then able to switch, allowing the low signal level at its terminal B to be transferred to its terminal A, and hence to terminal B of delay device N+1, by pulling down terminal A of delay device N+2 against the current drive from the transistor 336 of the delay device N+1. This procedure will be described in greater detail further on in the specification.

After the DIRN SET output has gone low, the Q3 output of counter 348 goes high, and is inverted by inverter 347. A low PROG ENABLE signal from the output of inverter 347 removes the set control at the flip-flop 346, and the reset control from either one of flip-flops 368 or 370, depending on the state of flip-flop 344, the outputs of which determine the direction of programming. If the Q output of flip-flop 344 is high, indicative of an anti-clockwise programming direction from terminal B to terminal A, then flip-flop 368 remains reset via OR gate 371, and will not participate in the programming procedure. On the other hand, if the Q* output of flip-flop 344 is high, indicating a clockwise programming direction, flip-flop 370 will remain reset via OR gate 372 and will not participate in the programming process.

At this stage, the delay devices are individually set up to receive all the timing signals in the clockwise direction, from terminal A to terminal B, if no discontinuity has been detected in the harness 14. The pnp transistor 334 will be turned on to enable the buffer 302 to receive a negative-going programming pulse arriving at terminal A. Where terminal B is connected to a functioning delay device, it will be held high by the pnp transistor of the A terminal of that delay device. On the other hand, the other pnp transistor 336 will be turned off, and its corresponding terminal B will be held low by pull-down resistor 328 if connected either to the non-programming port B of the controller, or to a faulty delay device or a broken section of harness. In the case of a discontinuity the delay device with its terminal A adjacent the B terminal of the aforementioned delay device, the buffer 302 may be set up to receive negative-going programming pulses arriving at its terminal B in the anti-clockwise direction with its pnp transistor 336 turned on and its pnp transistor 334 turned off, thereby allowing the signal level at terminal A to follow that at terminal B.

The controller 12 then places both its A and B ports 20 and 22 in a high impedance state which allows them to float high under the influence of the adjacent delay devices, except in cases where there is no harness damage, in which case port B of the controller will then be pulled low by the resistor 328 of the adjacent delay device N+2.

In the event of a discontinuity arising at 362, for example, it becomes necessary for the controller 12 to determine the exact location thereof, so that the correct timing signals can be programmed into the delay devices on either side of such a discontinuity.

To this end, after having been set up for clockwise or anti-clockwise programming, each delay device undergoes a quasi-programming routine in which it is programed with a short negative-going pulse from the controller 12, during which time it responds via the DETONATOR line in the manner described hereinafter.

In the event of a break being detected, such as that at 362, a string of short negative-going pulses are transmitted out of port A by the controller for quasi-programming of the delay devices 1,2 . . . to N. The delay devices 1 to N have been set up for programming in a clockwise direction, and the first quasi-programming, or counting pulse transmitted from port A of the controller bypasses the delay devices 1 to N−1, which are set up in the signal bypass mode, with their B terminals pulled high by the pnp transistor 334 of the adjacent delay device. Due to the fault 362, the delay device N has its B terminal pulled low by pull-down resistor 328 which causes it to operate in a signal storage mode, allowing it to accept the first negative-going counting pulse. After programming has taken place, the A terminal of the delay device is pulled low by the pull-down resistor 326, causing the B terminal of the adjacent N−1 delay device to be pulled low, thereby permitting it to operate in the signal storage mode for acceptance of the next negative-going quasi-programming signal. In this manner, quasi-programming of the delay devices occurs in the reverse order N to 1. Once delay device 1 has been "programmed", its A terminal is pulled low, which in turn pulls low the signal level at port A, as its buffer is caused to "float" in a high impedance mode.

During the testing and delay device counting procedure as described above, each quasi-programming signal is returned via the DET POWER line, which is linked in parallel to each delay device, as was shown in FIGS. 4 and 7, once "programming", or counting of the delay device has taken place. If the break at 362 had caused all the lines in the harness 47 to sever, the counting signals would be returned into port A of the controller 12 via the DET POWER line. If, on the other hand, the break at 362 had only caused the PROG line to sever, the quasi-programming signals would be returned into both port A and port B. The number of signals returning on the DET POWER line is then counted by the controller, and this number is then stored in the controller.

A string of negative-going counting pulses is then transmitted by the B port of the controller 12 so as to "programme" the delay devices N+1 and N+2. By monitoring the DET POWER line, the number of delay devices which need to be programmed in the anti-clockwise direction can be ascertained.

By storing the number of delay devices on either side of the break 362, the controller 12 is able to access from its ROM table the correct timing signal for each delay device. Furthermore, by establishing the programming pattern, the approximate location of the break 362 can be ascertained, as well as the number of delay devices which are available for programming. The situation could arise where the harness 47 is broken in two places, both at 362 and at 363 for example. In this case, the counting pulses would count only four delay devices, namely 1, 2, N+1 and N+2, in communication with the controller 12. Assuming that the total number of delay devices should be linked together in the system is known to be fifty, it can thus readily be ascertained that not all of the devices are linked to the controller 12, and as a result the entire routine will be aborted.

If there is no break in the harness, and the delay devices are set up to programme in a clockwise direction, the same count routine may be followed to confirm that the correct number of delay devices are connected to the controller 12.

After the delay devices have been set up and counted, powering down of all the delay devices occurs by lowering the logic power line so as to reset the delay devices and erase the counting signal which as been programmed into each set counter of the delay device. The delay devices are then powered up and the direction set routine is then followed by the raising port B, in the case of the break of the harness, or by lowering port B, in the case of no break having been detected. The buffers 50 and 52 of respective A and B ports are then placed in the high impedance mode prior to actual programming of the timing signals into the delay devices. During actual programming, the delay devices operate in exactly the same manner as has previously been described with reference to the quasi-programming, or counting routine.

After the timing signals have been programmed into the delay devices, the DET POWER line is raised to charge the capacitors in each delay device, as has been described previously with reference to FIG. 3B at 115, and the DET POWER line is then lowered at 120 to trigger the delay devices, causing them to activate their associated detonators after the expiry of the time delay which has been programmed into each of the delay devices. The flow chart of FIG. 14 clearly sets out the procedure described above, and requires no further explanation.

Figure 13C:
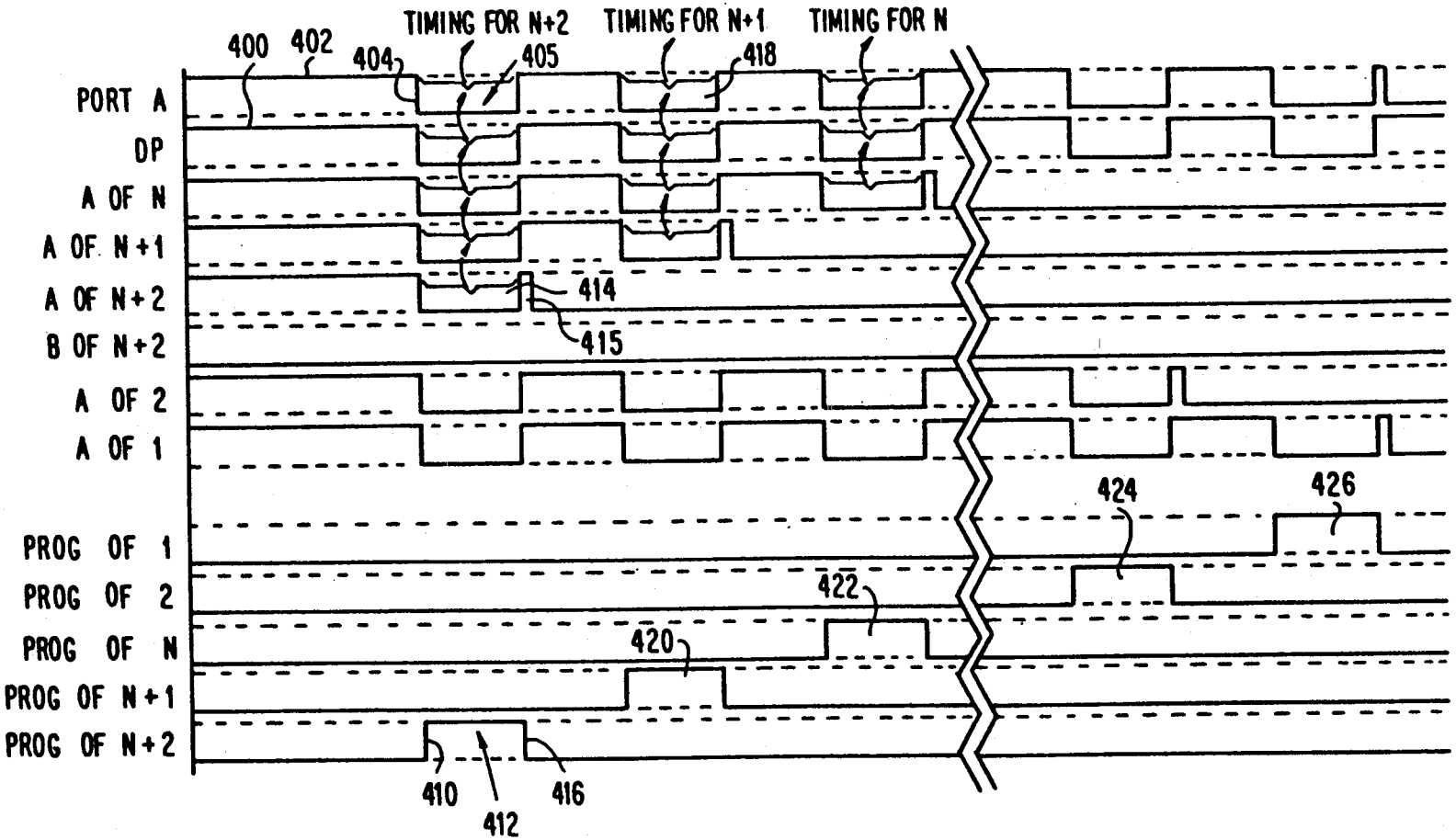
FIG. 13C shows a timing diagram illustrating the manner in which programming of the delay devices of FIG. 11 is effected where no break in the harness occurs.

Reference will now be made to FIG. 13C, which shows a timing diagram of programming in the clockwise direction, where no break in the harness 14 has occurred. The controller 12 raises its DETONATOR line to a monitoring level 400. Port A of the controller is held at 402 by the pull-up resistor 330 and the pnp transistor 334 of the adjacent delay device 1. The controller 12 then lowers port A at 404 to indicate the beginning of the first programming pulse. The Q output of flip-flop 344 is low, indicating a clockwise programming direction from terminal A to terminal B. The reset condition is consequently removed from flip-flop 368 via OR gate 371, thereby enabling it, and the Q* output of flip-flop 344 causes the flip-flop 370 to reset via OR gate 372, thereby effectively disabling it.

The delay devices 1 to N+2 are now set up for the propagation of negative-going programming pulses in the clockwise direction, with their B terminals being held high by the pnp transistors 334 of the adjacent delay devices. The signal level at terminal B will thus follow that at terminal A via AND gate 350 and npn transistor 340 after a short propagation delay. If terminal B of delay device 1 is high, indicating an adjacent unprogrammed delay device 2, the high input at terminal B is inverted by inverter 376 to provide a low D input for flip-flop 368.

Once terminal A of delay device 1 goes low, it is inverted by inverter 378, thereby clocking the low D input into flip-flop 368, so as to hold the Q* output of flip-flop 368 high. As the flip-flop 370 has its reset input held high via the OR gate 372, both the Q* inputs of AND gate 380 are high, providing a high output for OR gate 382. Any change on the output of OR gate 382 is thereby prevented, and the flip-flop 346 is left unaffected. As the PROG output of the AND gate 386 is low, a programming pulse is not programmed into the delay device, but is propagated through the delay device 1 out of the B terminal to the next delay device 2 in the series.

If, on the other hand, terminal B of a delay device is low, this indicates one of the three abovementioned conditions. The delay device N+2 is thus ready to be programmed with a timing signal in the following manner.

The D input of flip-flop 368 will be high via the low input from terminal B when terminal A goes low, the inverter 378 clocking the inverted high D-input into flip-flop 368, thereby causing the Q* output of flip-flop 368 to go low. This in turn causes the respective outputs of AND gate 380 and OR gate 382 to go low. Consequently, inverter 384 provides a high input at AND gate 386, which together with the high input provided by the Q output of flip-flop 346, raises the PROG line, as is shown at 410, and a positive pulse 412 having the duration of the negative-going pulse 405 is thus stored in the set counter 130 of the delay device N+2.

When terminal A of delay device N+2 goes high, as is shown at 414, the output of OR gate 382 also rises, thereby clocking in the low on the input of flip-flop 346 to lower its Q output. The PROG output of AND gate 386 is thus lowered, as is shown at 416. At the same time, the high Q* output of flip-flop 346 ensures that the outputs of OR gates 351 and 358 are held high, thereby switching off pnp transistors 334 and 336 by raising their bases. The Q output of flip-flop 346, which is held low, provides low inputs for AND gates 350 and 353, thereby ensuring that npn transistors 338 and 340 are held off. This ensures minimum current drain when programming of the delay device N+2 is complete.

As the A terminal of the delay device N+2 is held low subsequent to the programming thereof, the B terminal of the delay device N+1 is held low, signifying that it should receive the next negative-going programming signal 418 which emanates from port A of the controller 12. The programming of the delay device N+1 occurs in exactly the same manner as has previously been described, with a timing signal 420 being stored in its set counter 130.

Between generating the programming signals, the controller 12 switches its port A to high impedance to allow it to determine if the delay device 1 adjacent port A has been programmed. This will be indicated by the port A output of the controller 12 being pulled low by pull-down resistor 326 of delay device 1. Should this not be the case, the sequence as described above is repeated until all the delay devices in electrical communication with port A have been programmed.

Figure 13D:
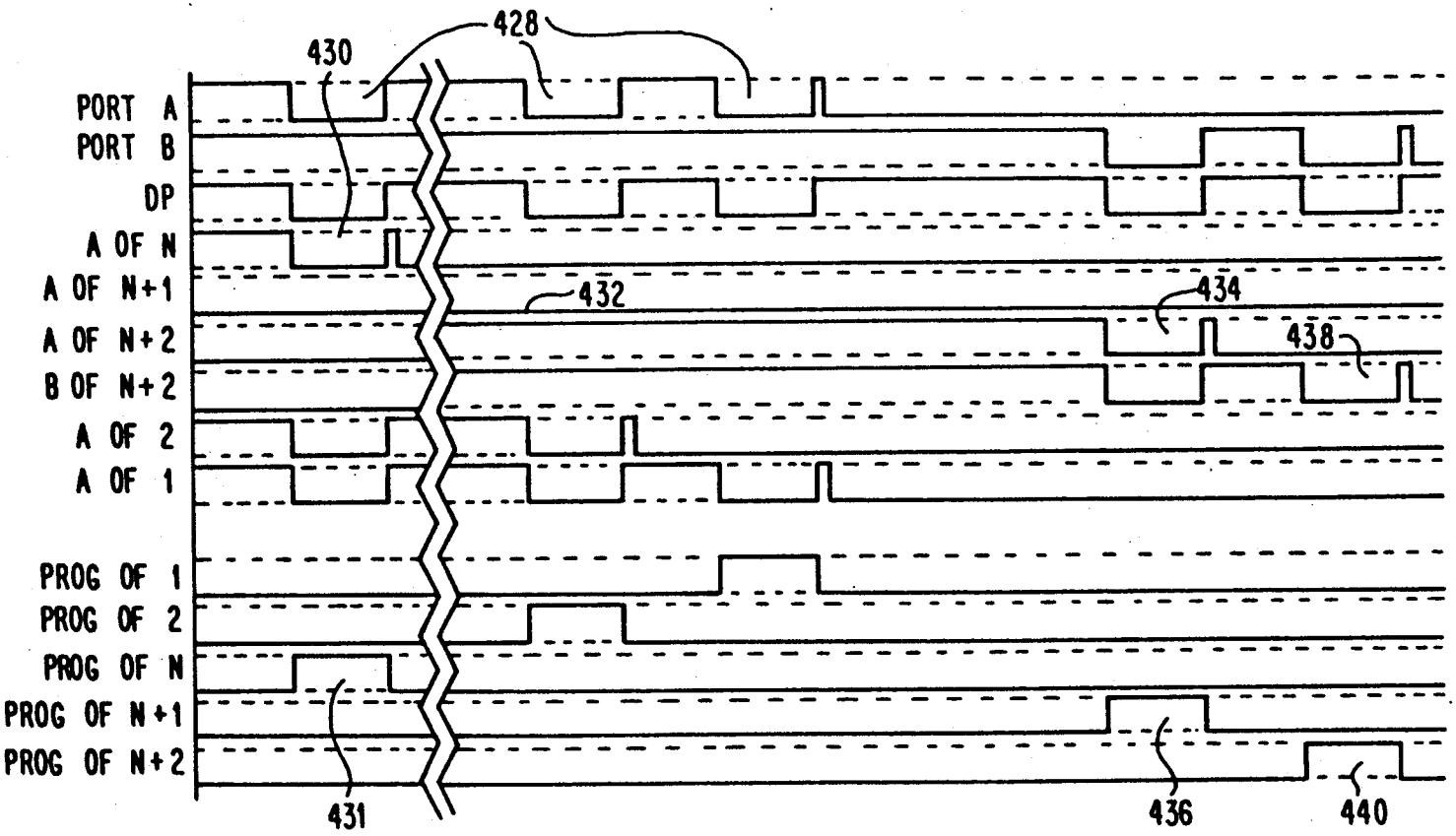
FIG. 13D shows a timing diagram illustrating the manner in which programming of the delay devices of FIG. 11 is effected where a break in the harness occurs.
Figure 14:
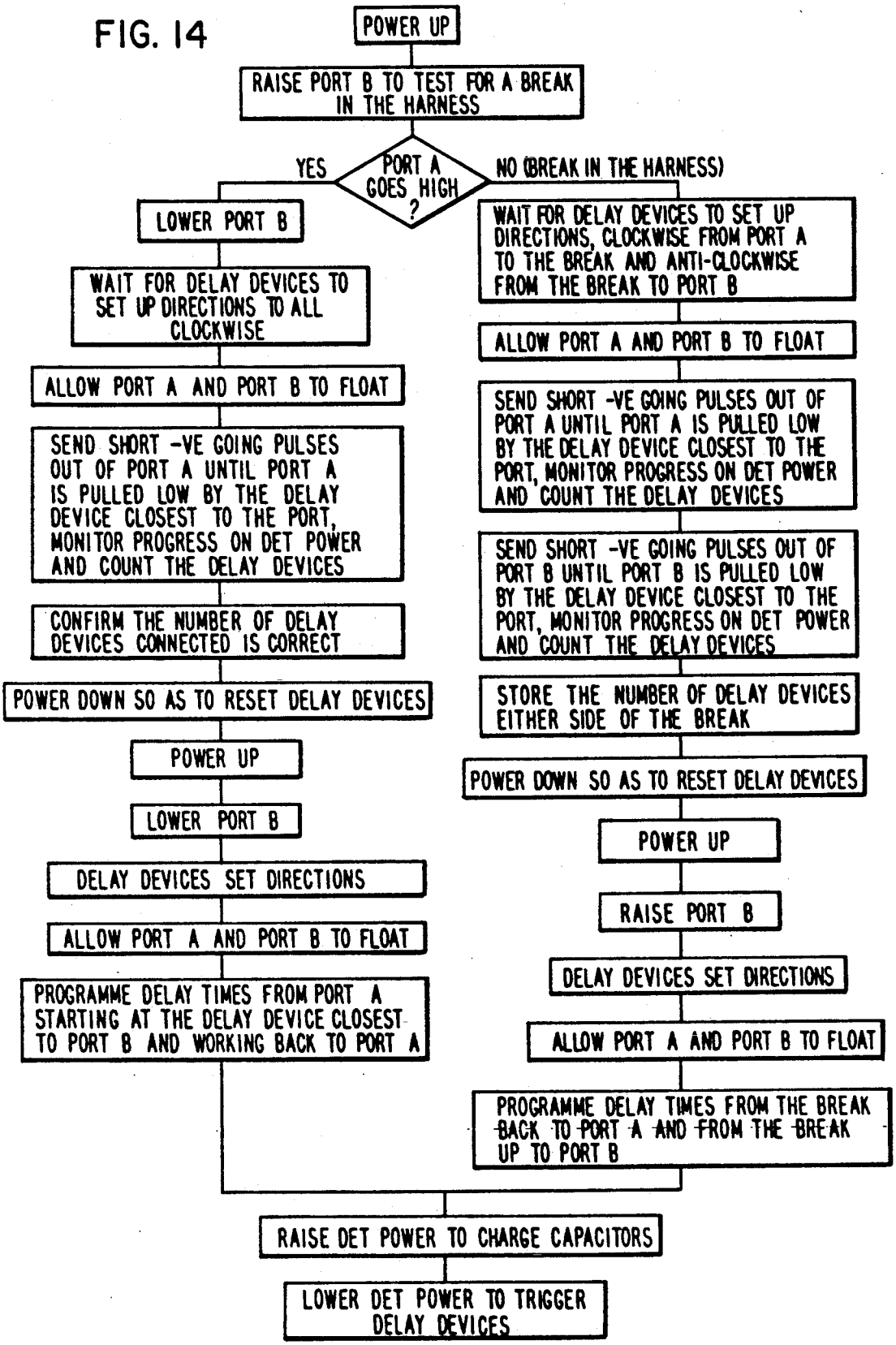
FIG. 14 shows a flowchart indicating the steps involved in the programming and triggering of the timing apparatus of FIG. 11 for respective unbroken and broken harnesses.

In FIG. 13D, a timing diagram corresponding to the configuration of delay devices as is illustrated in FIG. 11 is shown, with the break 362 present.

N negative-going programming signals 428 are transmitted from port A of the controller, with the signal 430 being programmed into the delay device N at 431. Due to the break 362, both the B terminal of the delay device N and the A terminal of the delay device N+1 are held low, as is illustrated at 432. After programming of the delay devices 1 to N has occurred in the clockwise direction, programming of the delay devices N+1 and N+2 then takes place, with the first timing signal 434 being programmed into the delay device N+1, as is shown at 436, and the second timing signal 438 being programmed into the delay device N+2, as is shown at 440.

Programming in the anti-clockwise direction occurs in exactly the same manner, with the timing pulses being sourced from port B of the controller 12 and the delay devices in electrical communication with port B configuring themselves so that the pnp transistors 336 are turned on, as has previously been described.

The apparatus of the invention has a number of noteworthy features which distinguish it over the prior art. In addition to the bidirectional configuration of the central control unit, the harness and the delay devices, it enjoys a number of safety features which have been described in some detail with reference to FIG. 2 and 3. The mechanical switch provided by the motor 80 and the slug 86 ensures that electronic failure cannot trigger the detonators when the slug is in the earthed position 88. Furthermore, as the lines of the harness 14 are shorted together and earthed during all periods when the delay devices are not being programmed by the controller, and especially just after the delay devices have been triggered, the existence of potentially dangerous triggering signals in the harness lines resulting from RF interference is avoided, and the problem of live harness wires being blown around by the subsequent explosion is eliminated.

Moreover, electronic interlocks are provided by the retriggerable monostables 96 and 118, ensuring that any electronic failure in the functioning of the microcomputer 28 or its associated software will result in the pulse trains enabling the power supplies to the LOGIC or DETONATOR lines being adversely affected, thereby disabling the power supplies and ensuring that the system can only be powered providing the microcomputer 28 is fully operational.

An additional safety feature results from the provision of separate lines (namely the LOGIC and the DETONATOR line) to respectively program the delay devices and charge up their capacitors. The capacitors are only charged up just prior to blasting, and thus even if the switch 162 is accidently triggered, the detonator will not be activated as no charge will have been stored on the capacitor.

Programming of the timing apparatus of the invention is interactive, with the result that absence of a feedback signal from a delay device allows rapid detection of a faulty detonator or a section of harness. The ability of the apparatus to monitor exactly how many detonators have been programmed also allows a quick decision to be made as to whether repairs should be effected, whether the whole operation should be aborted, or whether the blasting operation should be continued with.

Naturally, the invention is not confined to use in sequential blasting, but may also be used in conjunction with pyrotechnic displays and with multiple fuses.

The interactive communication between the controller and the various delay devices enhances the timing precision of the imprecise local oscillator at each delay device; timing signals or digital words are transmitted from the control unit to calibrate the local oscillator. Errors caused by unpredictable phase knowledge of the local oscillator are reduced by using the local oscillator signal to initiate programming of the timing signal from the controller.

The bidirectional programming ability of the controller means that a discontinuity or bad connection in the harness, or a single faulty delay device will not necessarily result in the aborting of the blasting operation, as the reference timing signals can merely be re-routed in the opposite direction. This feature increases safety and reduces costly down-time.

We claim:

1. Apparatus for activating a plurality of electrical loads after predetermined time delays comprising:
   a) a central control unit for generating timing signals;
   b) a plurality of remote electrical delay devices, each delay device being associated with a corresponding electrical load and arranged to be serially programmed by a timing signal originating from the central control unit, the timing signal determining the time delay;
   c) at least one bidirectional timing signal line for allowing the timing signals to be transmitted in series from the central control unit to each remote electrical delay device in either of two alternative directions;
   d) sensing means for sensing a fault in the timing signal line; and
   e) direction selection means for selecting the direction of transmission of the timing signals along the bidirectional timing signal line, the direction selection means in use selecting a direction of transmission opposite to the initial direction of transmission of the timing signals from the control unit in the event of said fault being sensed in the timing signal line, for programming those delay devices which cannot be programmed in the initial direction.

2. Apparatus as claimed in claim 1 in which the central control unit has first and second signal I/O ports to which opposite ends of the bidirectional timing signal line are connectable, the second signal I/O port in use receiving a signal transmitted from the first signal I/O port via the bidirectional timing signal line, and vice versa, in the event of no fault existing in the timing signal line or the remote electrical delay devices.

3. Apparatus as claimed in claim 2 in which the sensing means comprises microprocessor-controlled signal generating means for generating a test signal and for transmitting the test signal from one of the signal I/O ports of the central control unit to the other along the bidirectional timing signal line, and test signal receipt means for detecting the presence of the test signal at the opposite signal I/O port from which it was transmitted.

4. Apparatus as claimed in claim 2 in which individual timing, triggering and power signals are transmissible along separate respective bidirectional timing, triggering and power signal lines which, together with a ground line, constitute a harness, opposite ends of the harness being connectable to ports at the control unit, which include the first and second respective signal I/O ports.

5. Apparatus as claimed in claim 4 which includes safety control means for ensuring that the delay devices are not programmed or triggered by spurious signals, the safety control means including switching means for disconnecting the signal lines from the control unit and for shorting them to the ground line.

6. Apparatus as claimed in claim 5 in which the switching means are operable by a motor-powered slug from a safe position, in which the signal lines are isolated from the central control unit and shorted to ground, to an enabled position, in which the signal lines are connected to the I/O ports of the control unit.

7. Apparatus as claimed in claim 5 in which the control unit includes microcomputer monitoring means for monitoring a microcomputer which controls the operation of the central control unit, and power supply means for powering the power and trigger signal lines, the microcomputer monitoring means only activating the power supply means in the event of the microcomputer operating normally.

8. Apparatus as claimed in claim 1 in which the direction selection means is responsive to the sensing means, and forms part of a microprocessor-based routine at the control unit.

9. Apparatus for activating a plurality of electrical loads after predetermined time delays comprising:
   a) a central control unit for generating timing signals;
   b) a plurality of remote electrical delay devices, each delay device being associated with a corresponding electrical load and arranged to be serially programmed by a timing signal originating from the central control unit, the timing signal determining the time delay;
   c) at least one bidirectional timing signal line for allowing the timing signals to be transmitted in series from the central control unit to each remote electrical delay device in either of two preselected directions;
   d) monitoring means for monitoring the number of electrical delay devices which have been correctly programmed, and deactivation means for deactivating the delay devices and aborting the blasting procedure in the event of a predetermined number of delay devices not having been programmed correctly.

10. Apparatus as claimed in claim 9 in which the monitoring means includes fault location means for locating the position of a fault in relation to the delay devices, and counting means for counting the number of delay devices on opposite sides of the fault, for establishing the correct timing signal pattern to ensure that each delay device is programmed with its corresponding timing signal.

11. Apparatus as claimed in claim 9 in which the monitoring means is in the form of a counter for counting the number of timing signals received at the control unit along the timing signal line, a memory module for storing the number of delay devices being utilized for a particular blasting operation, and comparator means for comparing the timing signals that have been counted with the number of delay devices stored in the memory module.

12. Apparatus for activating a plurality of electrical loads after predetermined time delays comprising:
   a) a central control unit for generating timing signals;
   b) a plurality of remote electrical delay devices, each delay device being associated with a corresponding electrical load and arranged to be serially programmed by a timing signal originating from the central control unit, the timing signal determining the time delay; and c) at least one bidirectional timing signal line for allowing the timing signals to be transmitted in series from the central control unit to each remote electrical delay device in either of two preselected directions, wherein:

the central control unit includes a precise timing pulse generator, measuring means for measuring pulse duration and computation means for computing a correction factor, and each delay device includes an imprecise timing pulse generator, each delay device being responsive to a signal from the central control unit to transmit at least one imprecise timing pulse to the central control unit for measurement of the duration thereof using the measuring means, the computation means in use computing a correction factor on the basis of the ratio between the duration of the imprecise timing pulse and a precise timing pulse from the precise timing pulse generator and applying this correction factor to a timing signal for receipt by a delay device.

13. Apparatus as claimed in claim 12 in which the precise and imprecise timing pulse generators are in the form of respective local and precision oscillators, and the timing signal is in the form of a digital word.

14. Apparatus for activating a plurality of electrical loads after predetermined time delays comprising:

a) a central control unit for generating timing signals;

b) a plurality of remote electrical delay devices, each delay device being associated with a corresponding electrical load and arranged to be serially programmed by a timing signal originating from the central control unit, the timing signal determining the time delay;

c) at least two timing signal paths interconnecting the central control unit and each remote electrical delay device, for allowing the timing signals to be transmitted in series from the central control unit to each remote electrical delay device;

d) sensing means for sensing a fault in the timing signal paths, and e) selection means responsive to the sensing means for selecting the first or the second timing signal path.

15. A method of activating a plurality of electrical loads after predetermined time delays comprising the steps of:

a) connecting a plurality of remote electrical delay devices in series with a central control unit using a bidirectional timing signal line, each delay device being associated with an electric load;

b) generating at the central control unit timing signals which determine the time delays;

c) transmitting the timing signals in series from the central control unit along the bidirectional timing signal line to each remote electrical delay device for programming thereof;

d) testing for a fault in the bidirectional timing signal line and, in the event of a fault existing, selecting the direction of transmission of the timing signals along the bidirectional timing signal line in accordance with the location of the fault.

16. A method of activating a plurality of electrical loads after predetermined time delays comprising the steps of:

a) connecting a plurality of remote electrical delay devices in series with a central control unit using a bidirectional timing signal line, each delay device being associated with an electric load;

b) generating at the central control unit timing signals which determine the time delays;

c) transmitting the timing signals in series from the central control unit along the bidirectional timing signal line to each remote electrical delay device for programming thereof;

d) monitoring a number of electrical delay devices which have been programmed with said timing signals and deactivating the control unit and the delay devices and aborting the activating procedure int he event of at least one of the delay devices not having been programmed correctly.

17. A method of activating a plurality of electrical loads after predetermined time delays comprising the steps of:

a) connecting a plurality of remote electrical delay devices in series with a central control unit using a bidirectional timing signal line, each delay device being associated with an electric load;

b) generating at the central control unit timing signals which determine the time delays;

c) transmitting the timing signals in series from the central control unit along the bidirectional timing signal line to each remote electrical delay device for programming thereof;

d) locating the position of a fault in relation to the delay devices, and counting the delay devices on opposite sides of the fault between the fault and the control unit for establishing a timing signal pattern to ensure that each delay device is programmed with its correct corresponding timing signal.

18. A method of activating a plurality of electrical loads after predetermined time delays comprising the steps of:

a) connecting a plurality of remote electrical delay devices in series with a central control unit using a harness comprising a plurality of bidirectional signal lines and a ground line, each delay device being associated with an electric load;

b) isolating the signal lines from the central control unit and shorting them to the ground line;

c) selecting, at the central control unit, a timing pattern for blasting;

d) connecting the signal lines to the control unit after the elapsing of a stand-off time;

e) programming the delay devices with timing signals from the central control unit, the timing signals corresponding to the timing pattern;

f) testing for a fault in the bidirectional signal lines and, in the event of a fault existing, selecting the direction of programming of the timing signals in accordance with the location of the fault.

19. A method as claimed in claim 18 which includes the step of continuously monitoring the functioning of a microcomputer which controls the central control unit, and only allowing charge and trigger signals to be generated and transmitted along the signal lines in the event of the microcomputer functioning normally.

20. A method of activating a plurality of electrical loads after predetermined time delays comprising the steps of:

a) connecting a plurality of remote electrical delay devices in series with a central control unit using a harness comprising a plurality of bidirectional signal lines and a ground line, each delay device being associated with an electric load;

b) isolating the signal lines from the central control unit and shorting them to the ground line;

c) selecting, at the central control unit, a timing pattern for blasting;

d) connecting the signal lines to the control unit after the elapsing of a stand-off time;

e) programming the delay devices with timing signals from the central control unit, the timing signals corresponding to the timing pattern;

f) charging energy storage means which form part of each delay device with a charge signal from the central control unit along one of the signal lines;

g) triggering the delay devices with a trigger signal from the central control unit via one of the signal lines; and h) disconnecting the signal lines from the control unit and shorting them to the ground line.

21. A method as claimed in claim 20 which includes the further steps of transmitting at least one imprecise timing pulse from a delay device to the control unit, generating at least one precise timing pulse at the control unit, measuring the duration of the imprecise timing pulse, computing a correction factor on the basis of the ratio between the duration of the imprecise and precise timing pulses, and applying this correction factor to a timing signal for receipt by the delay device.

* * * * *